US011998155B2

(12) United States Patent
Kim et al.

(10) Patent No.: US 11,998,155 B2
(45) Date of Patent: Jun. 4, 2024

(54) DISHWASHER

(71) Applicant: SAMSUNG ELECTRONICS CO., LTD., Suwon-si (KR)

(72) Inventors: Sungjin Kim, Suwon-si (KR); Eunseok Kim, Suwon-si (KR); Heedong Roh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 35 days.

(21) Appl. No.: 17/702,191

(22) Filed: Mar. 23, 2022

(65) Prior Publication Data

US 2023/0031157 A1 Feb. 2, 2023

Related U.S. Application Data

(63) Continuation of application No. PCT/KR2021/018204, filed on Dec. 3, 2021.

(30) Foreign Application Priority Data

Jul. 30, 2021 (KR) ..... 10-2021-0100677

(51) Int. Cl.
*A47L 15/42* (2006.01)

(52) U.S. Cl.
CPC ..... *A47L 15/4263* (2013.01); *A47L 15/4246* (2013.01)

(58) Field of Classification Search
CPC ..... A47L 15/4263; A47L 15/4246
See application file for complete search history.

(56) References Cited

U.S. PATENT DOCUMENTS

| | | | |
|---|---|---|---|
| 6,666,531 | B2 | 12/2003 | Flowers |
| 6,764,147 | B2 | 7/2004 | Flowers |
| 8,857,034 | B2 | 10/2014 | Schaefer et al. |
| 9,913,567 | B2 | 3/2018 | Dries et al. |

(Continued)

FOREIGN PATENT DOCUMENTS

| | | |
|---|---|---|
| CN | 111557630 A | 8/2020 |
| EP | 1138248 | 1/2011 |

(Continued)

OTHER PUBLICATIONS

International Search Report dated Apr. 28, 2022 from International Application No. PCT/KR2021/018204.

*Primary Examiner* — Joseph L. Perrin
*Assistant Examiner* — Kevin G Lee
(74) *Attorney, Agent, or Firm* — STAAS & HALSEY LLP

(57) ABSTRACT

A dishwasher includes an improved structure to inhibit leakage of water. The dishwasher includes a main body and a tub inside the main body to form a washing space. The tub includes an upper panel, a lower panel, and a middle panel, and the tub is provided with a seaming portion between the upper panel and the middle panel, and between the middle panel and the lower panel. A door is configured to open and close the tub, and a bracket is coupled along an inner surface of the tub to form an accommodation space between the tub and the bracket. A seal is mounted in the accommodation space to provide a seal between the tub and the door, and a mounting member is arranged on the seaming portion to mount the seal in the accommodation space.

15 Claims, 26 Drawing Sheets

(56) References Cited

U.S. PATENT DOCUMENTS

| | | | | |
|---|---|---|---|---|
| 2005/0285487 | A1* | 12/2005 | Noh | A47L 15/4246 312/263 |
| 2006/0284525 | A1* | 12/2006 | Gorini | A47L 15/4253 312/228 |
| 2022/0183535 | A1* | 6/2022 | Lee | A47L 15/4263 |

FOREIGN PATENT DOCUMENTS

| | | | |
|---|---|---|---|
| EP | 2 529 655 | A1 | 12/2012 |
| EP | 2 224 840 | | 11/2014 |
| JP | 2001-292948 | A | 10/2001 |
| JP | 4349212 | | 7/2009 |
| KR | 20-0269246 | | 3/2002 |
| KR | 10-2005-0122349 | | 12/2005 |
| KR | 10-1297017 | B1 | 8/2013 |
| KR | 10-2021-0026166 | | 3/2021 |
| WO | 2009/003823 | | 1/2009 |

* cited by examiner

DISHWASHER

CROSS-REFERENCE TO RELATED APPLICATIONS

This application is a Continuation of PCT Application No. PCT/KR2021/018204, filed Dec. 3, 2021, which claims the priority benefit of Korean Application No. 10-2021-0100677, filed Jul. 30, 2021, the contents of both of which are incorporated by reference herein in their entirety.

BACKGROUND

1. Field

The present application relates to a dishwasher, and more particularly, to a dishwasher including an improved structure to prevent water leakage.

2. Description of Related Art

A dishwasher is a device that automatically cleans food residue on dishes using detergent and washing water.

In general, the dishwasher may include a washing tub providing a washing space, a door installed in a front surface of the washing tub so as to open and close the washing space, a dish rack installed in the washing tub so as to accommodate an object to be washed, a spray arm configured to spray washing water to the dish rack, a sump storing washing water, and a water supply flow path providing washing water stored in the sump to the spray arm.

A sealing member may be typically installed to minimize a gap between the tub and the door. The sealing member is provided to prevent the washing water or high-temperature steam generated inside the tub from leaking to the outside of the dishwasher.

However, when the sealing member is not mounted at a correct position of the tub and a bracket, a gap is generated between the sealing member and the door, and it may lead to a problem such as leakage of washing water or leakage of steam.

SUMMARY

The present disclosure is directed to providing a dishwasher including an improved structure to prevent leakage of water.

Further, the present disclosure is directed to providing a dishwasher capable of preventing a water leak and leakage between a door and a tub by improving a structure of the tub and a bracket to which a sealing member is mounted.

Further, the present disclosure is directed to providing a dishwasher capable of blocking a gap between a door and a tub, and completely blocking washing water and steam by providing a separate mounting member coupled to the tub and to which a sealing member is mounted.

One aspect of the present disclosure provides a dishwasher including a main body, a tub in the main body and configured to form a washing space, the tub having an opening and having at least two panels with a seam between the at least two panels, a door configured to open and close the opening in the tub, a bracket coupled to an inner surface of the tub to form an accommodation space between the tub and the bracket, a seal disposed in the accommodation space and configured to provide a seal between the tub and the door, and a mount on the seam in the tub to mount the seal in the accommodation space.

The tub may further include a bracket coupler configured to protrude from the tub at a position adjacent to the door to couple to the bracket to be coupled thereto.

The at least two panels of the tub include an upper panel, a lower panel and a middle panel, and the seam may include a first seaming portion formed between the upper panel and the middle panel, and a second seaming portion formed between the lower panel and the middle panel.

The bracket coupler may be formed by a portion of the tub that protrudes inward.

The bracket coupler may further include a plate portion configured to protrude inward of the tub, and a bent portion configured to extend to be stepped from the plate portion.

The bracket may have an I-shaped cross-section.

The bracket may further include a protrusion having one end which protrudes inward to inhibit separation of the seal.

The mount may be provided in at least one of the first seaming portion and the second seaming portion.

The mount may include a mounting body, and a separation prevention portion extending from the mounting body.

The mount may include a flat surface portion configured to be in contact with and supported by a surface of the bracket, an inclined surface portion configured to be in contact with and supported by the seam, and a contact surface portion in front of the flat surface portion and the inclined surface portion so as to be in contact with the seal.

The contact surface portion may further include an inclined portion having an inclination corresponding to the bracket coupler.

The mount may further include a flange shaped to support the bracket and the seam, and a wing to inhibit the mount from being separated toward an inside of the tub.

The mounting member may include a plastic or rubber or stainless-steel material.

The bracket and the tub may be coupled by at least one of welding, clinching, bonding, riveting, and screwing.

Another aspect of the present disclosure provides a dishwasher including a main body, a tub in the main body and configured to form a washing space, the tub having an opening and a seam between at least two panels forming the tub, a door configured to open and close the opening of the tub, a bracket extending from an inner surface of the tub to form a gap between the tub and the bracket, a coupler coupled to the bracket and positioned on the seam in the tub, and a seal positioned in the gap between the tub and the bracket and supported by the coupler to seal the gap between the tub and the bracket.

Another aspect of the present disclosure provides a dishwasher including a main body, a tub provided inside the main body, and including an upper panel provided to form an upper surface, a lower panel provided to form a lower surface, a middle panel provided to form opposite side surfaces and a rear surface, a first seaming portion formed between the upper panel and the middle panel, and a second seaming portion formed between the middle panel and the lower panel, a door configured to open and close the tub, a bracket coupled to an inner side of the tub so as to form an accommodation space, a sealing member provided to be inserted into the accommodation space, and a mounting member coupled to at least one of the first and second seaming portions to mount the sealing member to between the bracket and the tub The bracket may be formed to have an I-shaped cross-section, and the bracket may further include a protrusion formed to protrude inward to prevent separation of the sealing member.

The tub may further include a bracket coupling portion provided to protrude inward at a position adjacent to the door so as to allow the bracket to be coupled thereto.

The mounting member may further include an inclined portion having an inclination corresponding to the bracket coupling portion.

Another aspect of the present disclosure provides a method of manufacturing a dishwasher including forming a tub by coupling a first panel to a second panel through a seaming process and forming the tub to allow a bracket coupling portion, which protrudes inward, to be formed in a region except a seaming portion of the first panel and the second panel, coupling a bracket to the bracket coupling portion to form an accommodation space between an inner surface of the tub and the bracket, coupling a mounting member to the seaming portion to correspond to a protrusion height of the bracket coupling portion, and inserting the sealing member into the accommodation space to be supported by the bracket coupling portion and the mounting member.

The mounting member may include a flat surface portion formed to be in contact with and supported by one surface of the bracket, an inclined surface portion formed to be in contact with and supported by the seaming portion, and a contact surface portion provided to support the sealing member.

By improving a structure of a tub and a bracket to which a sealing member is mounted, it is possible to prevent leak of water and leakage between a door and the tub.

Further, it is possible to block a gap between a door and a tub, and completely block washing water and steam by providing a separate mounting member to the tub to which a sealing member is mounted.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
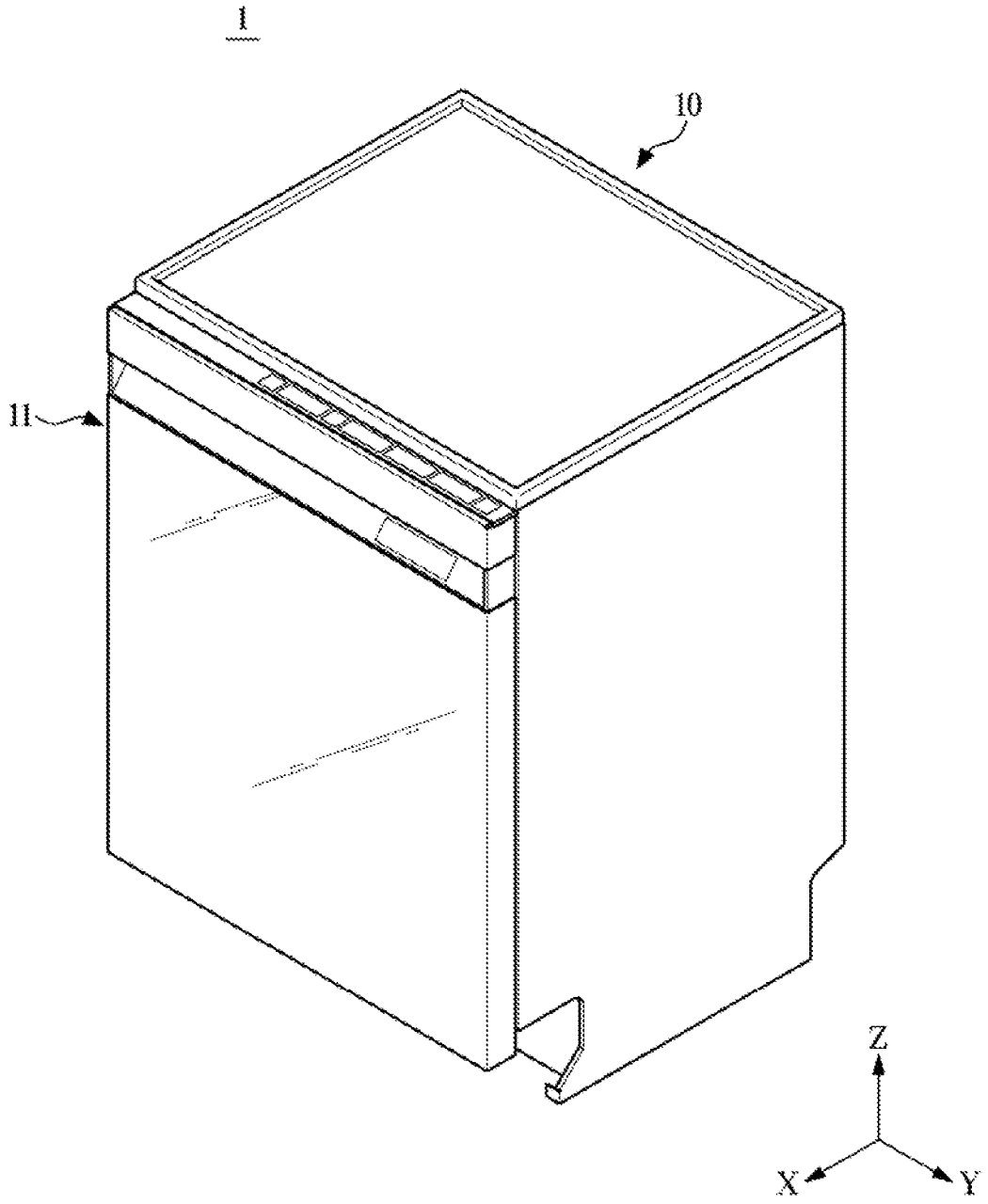
FIG. 1 is a perspective view illustrating a dishwasher according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms “a,” “an” and “the” are intended to include the plural forms as well, unless the context clearly indicates otherwise. In this disclosure, the terms “including”, “having”, and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element.

For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front portion", "rear portion", "upper portion", "lower portion", and the like may be defined by the drawings, but the shape and the location of the component is not limited by the term.

Figure 2:
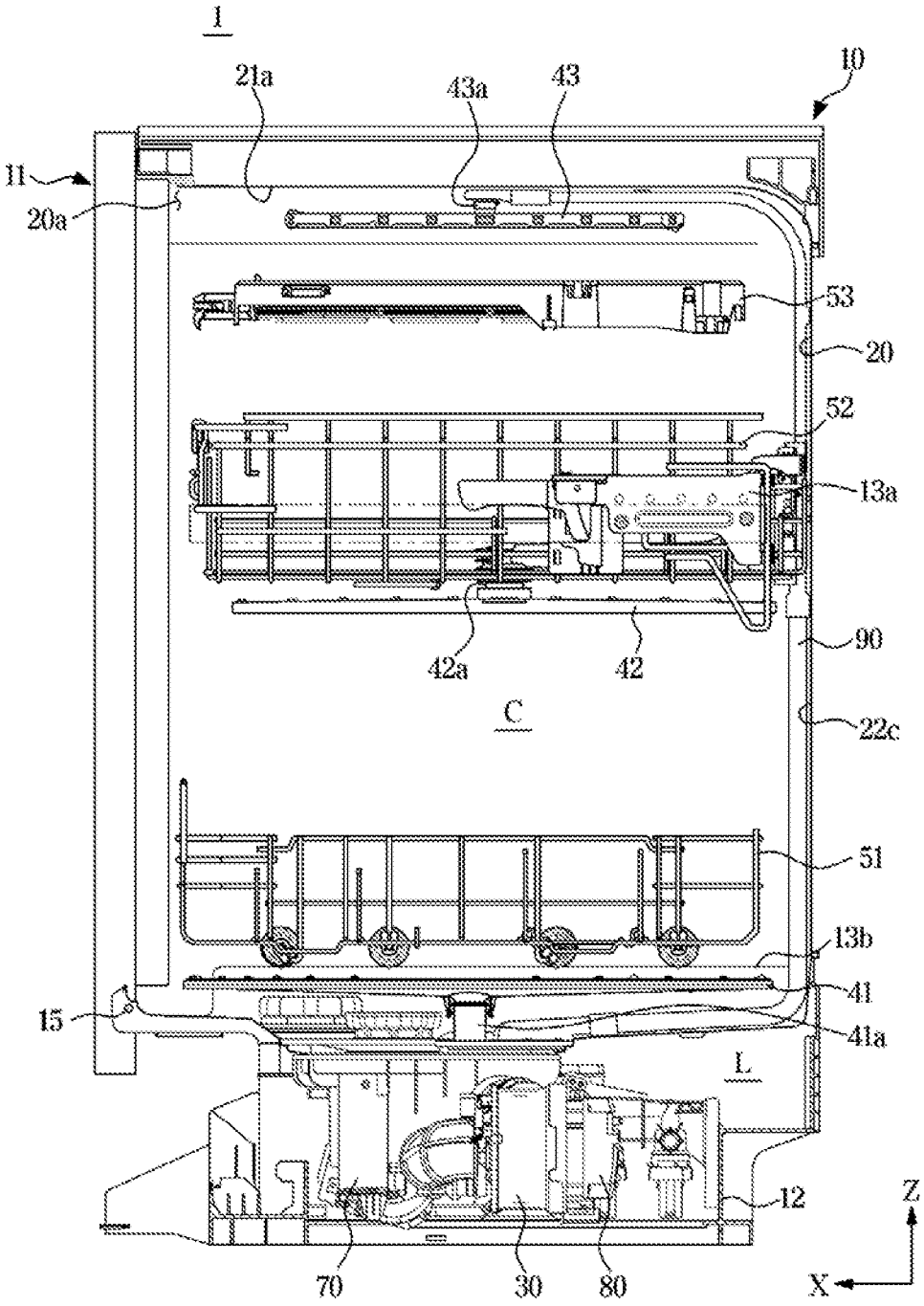
FIG. 2 is a longitudinal cross-sectional view of the dishwasher shown in FIG. 1.

Hereinafter, exemplary embodiments of the present disclosure will be described in detail with reference to the accompanying drawings FIG. 1 is a perspective view illustrating a dishwasher according to one embodiment of the present disclosure, and FIG. 2 is a longitudinal cross-sectional view of the dishwasher shown in FIG. 1.

Referring to FIGS. 1 and 2, a dishwasher 1 may include a main body 10 provided to form an exterior thereof.

The dishwasher 1 may include a tub 20 provided inside the main body 10. The tub 20 may be provided in a substantially box shape. A front surface of the tub 20 may be open. That is, the front surface of the tub 20 may correspond to an opening 20*a*.

The dishwasher 1 may include a door 11 configured to open and close the opening 20*a* of the tub 20. In order that the door 11 opens and closes the opening 20*a*, an upper portion or a lower portion of the door 11 may be hinged to the main body 10, but is not limited thereto. Alternatively, a side portion of the door 11 may be hinged to the main body 10 so as to open and close the opening 20*a*. Further, the door 11 may be installed on the tub 20 by an opening and closing structure other than a hinge.

The dishwasher 1 may further include a storage container provided inside the tub 20 to accommodate dishes. The storage container may include a plurality of baskets 51, 52, and 53.

The plurality of baskets 51, 52, and 53 may be arranged in a vertical direction Z of the dishwasher 1, and the plurality of baskets 51, 52, and 53 may include a lower basket 51, a middle basket 52 and an upper basket 53 which are arranged in order from bottom to up. The lower basket 51 may be provided to be supported by a lower guide rail 13*b*, and the middle basket 52 may be provided to be supported by a middle guide rail 13*a*. The upper basket 53 may be provided to be supported by an upper guide rail (not shown), and dishes having a relatively small volume may be accommodated therein. The middle guide rail 13*a* and the lower guide rail 13*b* may be installed on a side surface of the tub 20 to be slidable in a front and rear direction X toward the opening 20*a* of the tub 20.

However, the present disclosure is not limited thereto, and the upper basket 53 may be omitted depending on the size of the tub 20. Accordingly, the storage container may include only the middle basket 52 and the lower basket 51.

The dishwasher 1 may further include a sump 70 provided to store washing water. The dishwasher 1 may include a washing chamber C that is a washing space formed by the inside of the tub 20. The washing chamber C is a space in which dishes placed on the baskets 51, 52, and 53 may be washed by washing water and dried.

The washing chamber C may be defined as an inner space of the tub 20 formed by the sump 70. A specific structure of the tub 20 will be described later.

The dishwasher 1 may further include spray units 41, 42, and 43 configured to spray washing water. The spray units 41, 42, and 43 may include a first spray unit 41 disposed under the lower basket 51 with respect to a height direction of the dishwasher 1, a second spray unit 41 disposed under the middle basket 52 with respect to the height direction of the dishwasher 1, and a third spray unit 43 disposed above the upper basket 53 with respect to the height direction of the dishwasher 1.

The first spray unit 41 may be configured to be rotatable about a first rotating shaft 41*a*, the second spray unit 42 may be configured to be rotatable about a second rotating shaft 42*a*, and the third spray unit 43 may be configured to be rotatable about a third rotating shaft 43*a*.

However, one embodiment of the present disclosure is not limited thereto, and the first spray unit 41 may be fixed to one side of a lower surface 12*b* unlike the second spray unit 42 and the third spray unit 43. In this case, the first spray unit 41 is configured to spray the washing water in an approximately horizontal direction by a fixed nozzle, and washing water sprayed in the horizontal direction from the nozzle of the first spray unit 41 may be moved upward as a direction of the washing water is changed by a conversion assembly (not shown) arranged inside the washing chamber C.

The dishwasher 1 may include a circulation pump 30 configured to pump water stored in the sump 70 to the spray units 41, 42, and 43. The washing water pumped by the circulation pump 30 may be supplied to the first spray unit 41 through a stirring device 80 connected to the circulation pump 30 or moved upward by a duct 90 and supplied to the second spray unit 42 or the third spray unit 43.

The washing water collected in the sump 70 or the washing water flowing into the dishwasher 1 from the outside may flow to the stirring device 80 by the circulation pump 30. The stirring device 80 may supply washing water to the first spray unit 41 through a connector (not shown) connected to the first spray unit 41, and may supply washing water to the duct 90. The stirring device 80 may selectively supply washing water to at least one of the connector and the duct 90. The stirring device 80 may be disposed in a machine room L provided under the washing chamber C.

The dishwasher 1 may include the machine room L disposed under the tub 20. The machine room L may be formed by a lower frame 12.

Figure 3:
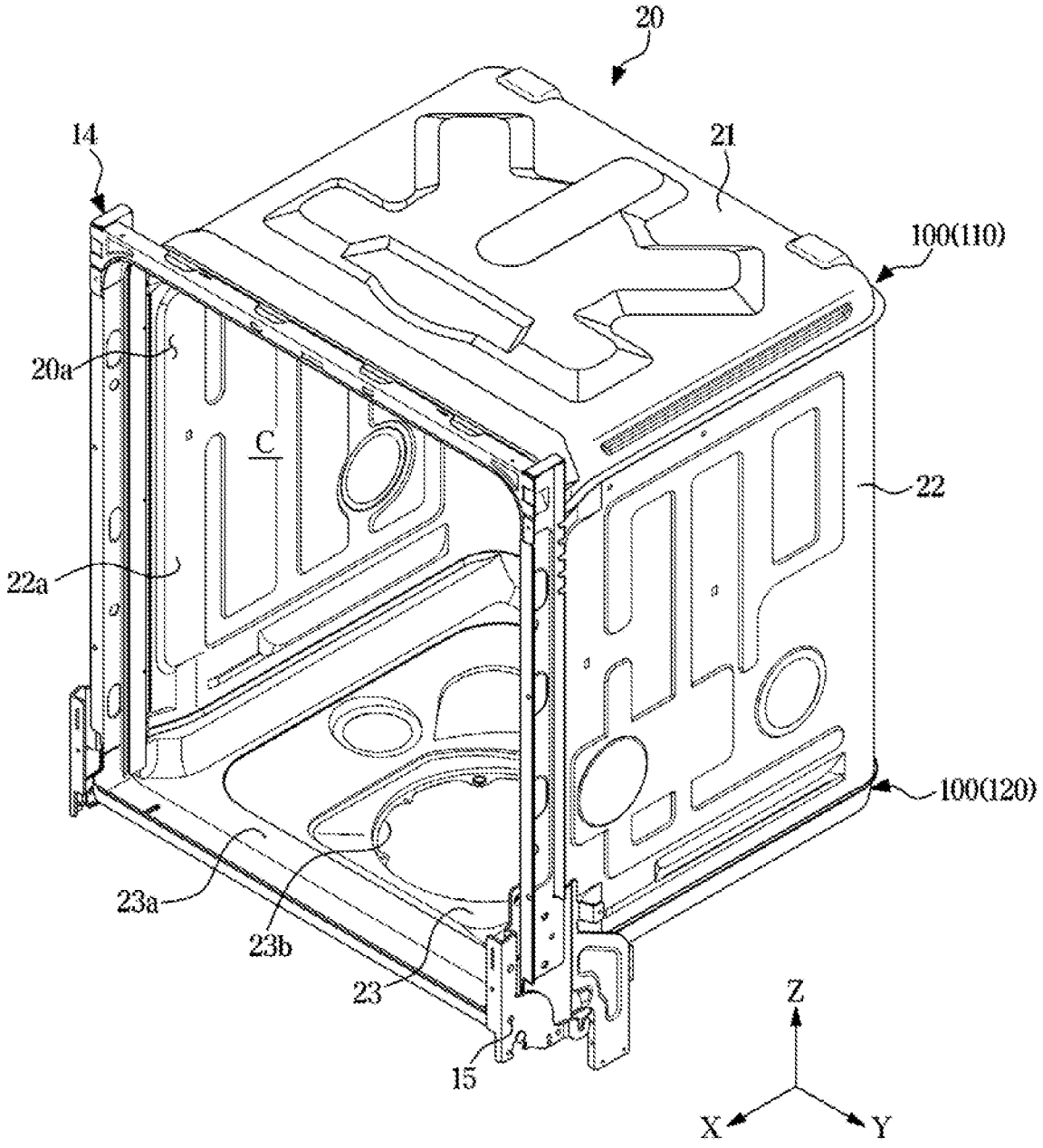
FIG. 3 is a perspective view illustrating a tub shown in FIG. 2.
Figure 4:
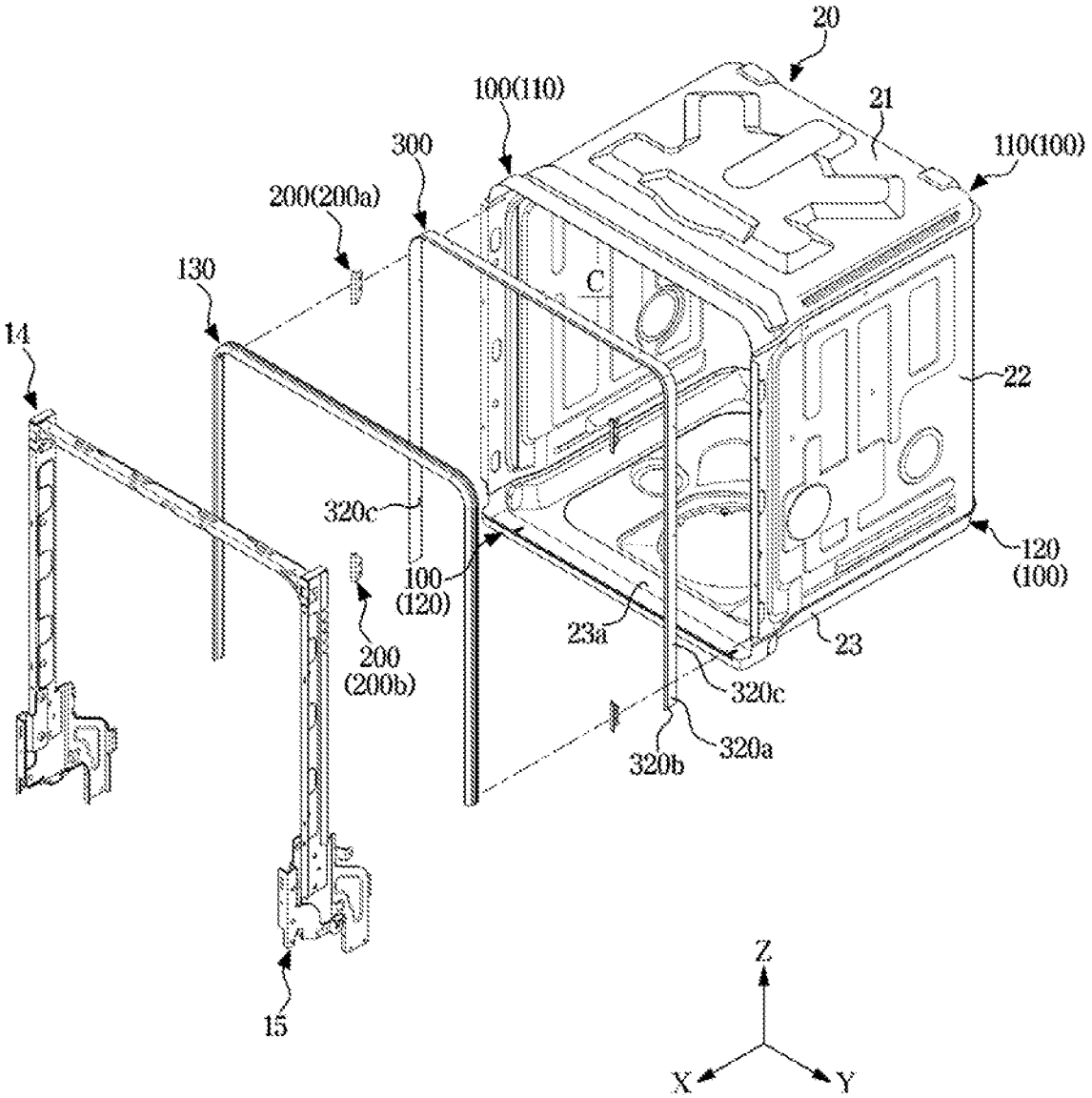
FIG. 4 is an exploded perspective view illustrating the tub shown in FIG. 2.

FIG. 3 is a perspective view illustrating a tub shown in FIG. 2, and FIG. 4 is an exploded perspective view illustrating the tub shown in FIG. 2.

As illustrated in FIGS. 3 and 4, the tub 20 of the dishwasher 1 may include an upper panel 21 forming an upper surface, a lower panel 23 forming a lower surface, and a middle panel 22 arranged between the upper panel 21 and the lower panel 23 so as to form a side surface and a rear surface.

The dishwasher 1 may include the tub 20 in which the washing chamber C is formed therein by combining the upper panel 21, the middle panel 22, and the lower panel 23.

A sump mounting portion 23*b* for mounting the sump 70, in which washing water is stored, may be formed in a central portion of the lower panel 23.

The dishwasher 1 may further include a front frame 14 provided to fix a front portion of the tub 20 and to which the door 11 is rotatably installed. The front frame 14 may be provided to prevent deformation and distortion of the dishwasher 1. A hinge 15 may be provided on the front frame 14 to fix the door 11. The hinge 15 may be provided at opposite lower ends of the front frame 14.

The front frame 14 may be provided to fix the front portion of the tub 20 so as to maintain the shape, diagonal, and strength of the tub 20.

The door 11 may be mounted to be rotatable with respect to the hinge 15 in the front frame 14 provided in front of the tub 20.

The dishwasher 1 may further include a seal or sealing member 130 disposed between the tub 20 and the door 11 to provide a seal between the tub 20 and the door 11.

The sealing member 130 may be provided to block the gap between the tub 20 and the door 11 to prevent or inhibit leakage of washing water and leakage of steam. The sealing member 130 may be provided to seal the upper portion and opposite side surfaces of the tub 20. The sealing member 130 may be provided to seal a gap between the upper panel 21 and the middle panel 22, and the door 11.

The sealing member 130 may be formed of an elastic material. For example, the sealing member 130 may include a rubber or silicone.

The tub 20 may be made by a seaming process to produce a seam in the tub. The tub 20 may be coupled by the seaming process. The upper panel 21 and the middle panel 22 may be coupled to each other by the seaming process. The lower panel 23 and the middle panel 22 may be coupled to each other by the seaming process.

The seaming process is a kind of sealing method and may be mainly used for seams requiring airtightness and water-tightness.

The tub 20 may be divided into three parts, such as the upper panel 21, the middle panel 22, and the lower panel 23, and a seaming portion 100 or a seam 100 may be provided at upper and lower portions, respectively.

The tub 20 may include a first seaming portion 110 provided to connect between the upper panel 21 and the middle panel 22 by the seaming process, and a second seaming portion 120 provided to connect between the lower panel 23 and the middle panel 22 by the seaming process.

Figure 5:
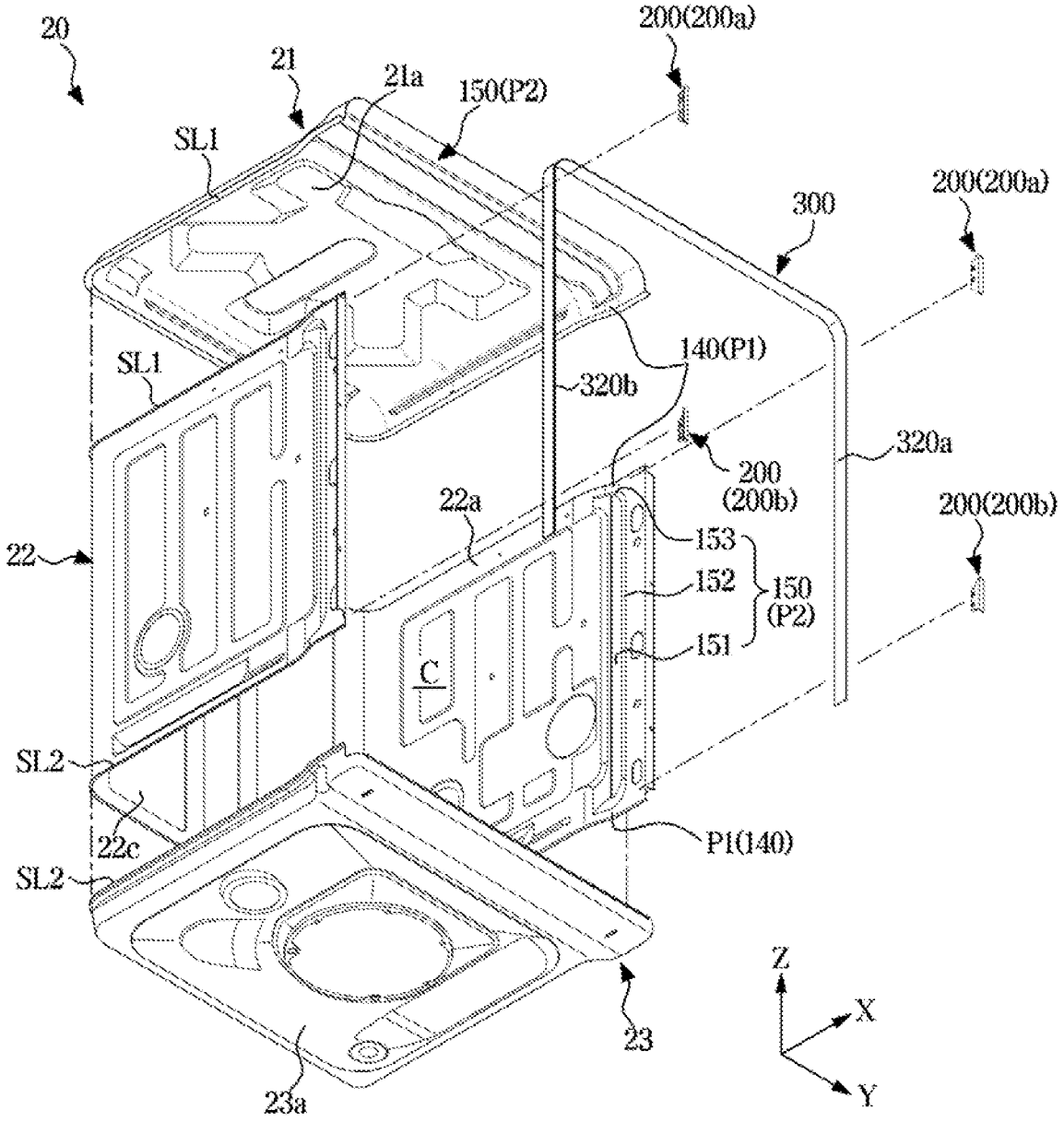
FIG. 5 is an exploded perspective view illustrating a bracket and a mounting member mounted to the tub according to one embodiment of the present disclosure.
Figure 6:
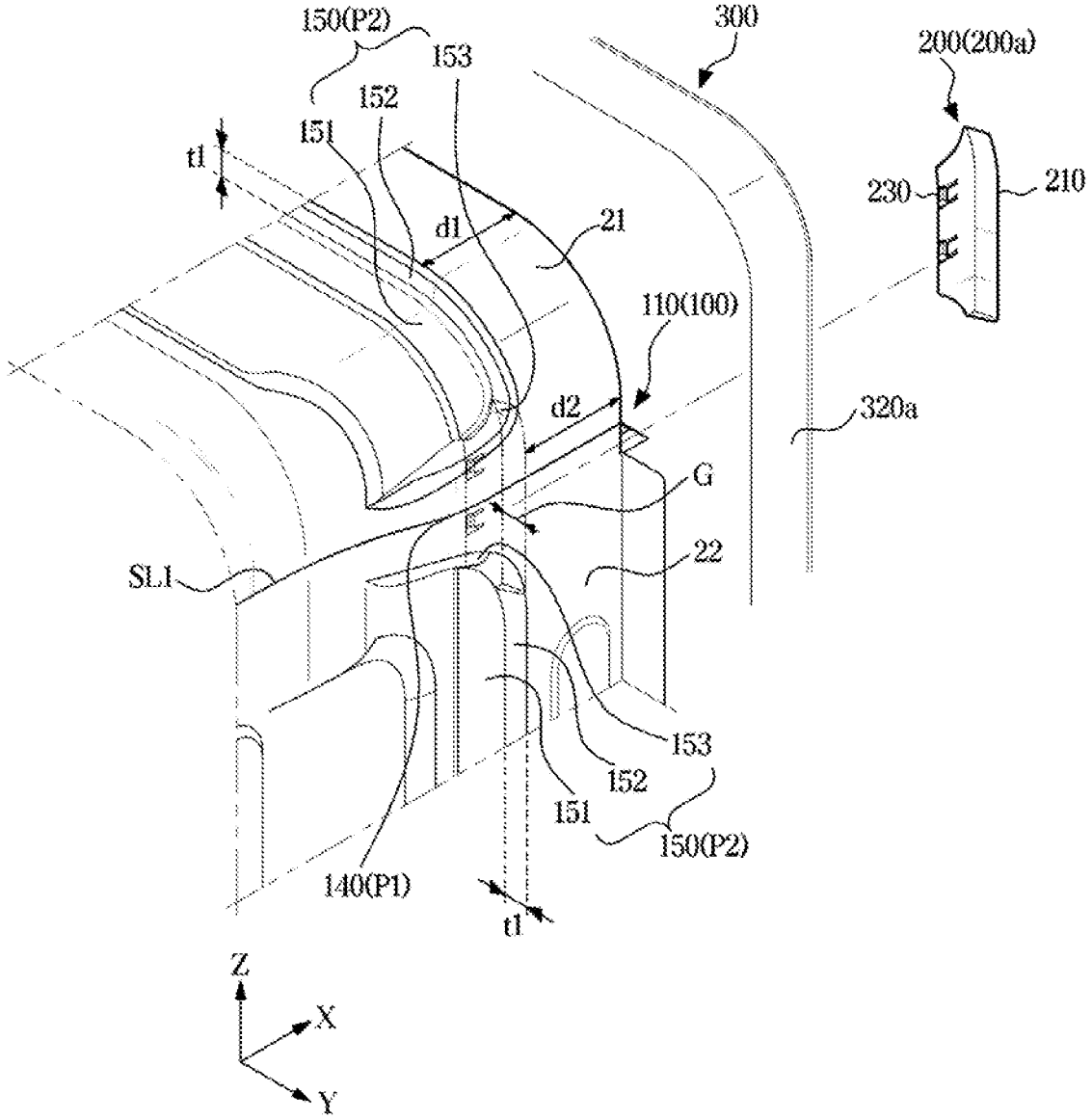
FIG. 6 is a partial exploded perspective view illustrating the mounting member mounted to the tub according to one embodiment of the present disclosure.

FIG. 5 is an exploded perspective view illustrating a bracket and a mounting member mounted to the tub according to one embodiment of the present disclosure, and FIG. 6 is a partial exploded perspective view illustrating the mounting member mounted to the tub according to one embodiment of the present disclosure. FIG. 6 is a view illustrating an inside of a right upper portion of FIG. 5.

As illustrated in FIGS. 5 and 6, the tub 20 may be formed by the upper panel 21, the middle panel 22 and the lower panel 23.

The washing chamber C of the tub 20 may include an upper surface 21*a*, a lower surface 23*a*, a side surface 22*a*, and a rear surface 22*c*. The side surface 22*a* may include a left surface and a right surface.

Particularly, the upper surface 21*a* of the washing chamber C may be formed by the upper panel 21. The lower surface 23*a* of the washing chamber C may be formed by the lower panel 23.

The upper panel 21 forming the washing chamber C may be formed to partially extend downwardly from the upper surface. The lower panel 23 forming the washing chamber C may be formed to partially extend upwardly from the lower surface. Accordingly, the opposite side surfaces 22*a* and the rear surface 22*c* of the washing chamber C may be formed by the middle panel 22 and at least a portion of the upper panel 21 and the lower panel 23. The opposite side surfaces 22*a* and the rear surface 22*c* of the washing chamber C may be integrally formed by the middle panel 22.

The tub 20 forming the washing chamber C may be formed through the seaming process of the upper panel 21, the middle panel 22, and the lower panel 23.

The tub 20 may include the first seaming portion 110 formed by the seaming process between the upper panel 21 and the middle panel 22 and the second seaming portion 120 formed by the seaming process between the middle panel 22 and the lower panel 23.

In order to perform the seaming process, ends of the upper panel 21 and the middle panel 22 may be bent by a predetermined length so as to come into contact with each other. In addition, ends of the middle panel 22 and an end of the lower panel 23 may be bent by a predetermined length so as to come into contact with each other.

The ends of the upper panel 21 and the middle panel 22 may be bent by a predetermined length so as to come into contact with each other through the seaming process, thereby forming the first seaming portion 110. The ends of the middle panel 22 and the lower tub 23 may be bent by a predetermined length so as to come into contact with each other through the seaming process, thereby forming the second seaming portion 120.

The tub 20 may include a first seaming line SL1 formed by the first seaming portion 110 formed to couple between the upper panel 21 and the middle panel 22, and a second seaming line SL2 formed by the second seaming portion 120 formed to couple the lower panel 23 and the middle panel 22. The first seaming portion 110 is positioned above the second seaming portion 120. The first seaming line SL1 may be positioned above the second seaming line SL2.

The tub 20 may include a first region P1 and 140 positioned on the first seaming line SL1 and the second seaming line SL2. The first region P1 and 140 of the tub 20 may be located in the seaming portion 100. The first region 140 of the tub 20 may include the first seaming portion 110 and the second seaming portion 120.

The tub 20 may include a bracket coupling portion 150 provided to allow a bracket 300, which is to be described later, to be coupled thereto. The bracket coupling portion 150 may include a second region P2 and 150 positioned in the front portion of the tub 20 to allow the bracket 300 to be fixed.

The second region 150 of the tub 20 may be provided to allow the bracket 300 to be in contact therewith. The second region 150 of the tub 20 may be provided on the upper panel 21. The second region 150 of the tub 20 may be provided on the opposite side surfaces 22*a* of the middle panel 22. The second region 150 of the tub 20 may be provided on the lower panel 23.

The first region 140 and the second region 150 of the tub 20 may be provided to allow the sealing member 130 to be coupled and mounted thereto. The first region 140 and the second region 150 may be formed in the front portion of the tub 20 to allow the sealing member 130 to be coupled thereto. Particularly, the first region 140 and the second region 150 of the tub 20 may be located close to the door 11 located in front of the tub 20. The first region 140 and second region 150 of the tub 20 may be placed at a position that is close to one-quarter and one-third of the cross-section of the tub 20 with respect to the front side. The first region 140 and the second region 150 of the tub 20 may be formed at a predetermined position from the front end of the tub 20. The first region 140 and the second region 150 may be formed at a predetermined position on a front edge of the tub 20. The first region 140 of the tub 20 may be located inside by a first distance d1 from the front end of the tub 20. The second region 150 of the tub 20 may be located inside by a second distance d2 from the front end of the tub 20. The first distance d1 and the second distance d2 may be formed to be the same.

The dishwasher 1 may further include the bracket 300 coupled to the tub 20 to allow the sealing member 130 to be installed in the tub 20. The bracket 300 may be coupled to the inner side of the tub 20. The bracket 300 may be disposed in the front side of the tub 20. The bracket 300 may be coupled to a front inner side of the tub 20. The bracket 300 may be disposed in the front side of the tub 20 to fix the front portion of the tub 20 and to maintain strength and diagonal.

The bracket 300 may be a middle structure provided between the front frame 14 and the tub 20, and may be provided to serve as a guide for fixing the front frame 14 to the tub 20.

The bracket 300 may be provided to allow the sealing member 130 to be installed in the tub 20. The bracket 300 may be coupled to the tub 20 to form an accommodation space S, in which the sealing member 130 is accommodated, between the bracket 300 and the tub 20. (Refer to FIGS. 9, 11 and 12) The bracket 300 may be coupled to a bracket coupling portion P2 and 150 of the tub 20, which is to be described later, to allow the sealing member 130 to be installed between the tub 20 and the bracket 300.

The bracket 300 may be provided so as to be in surface contact with and fixed to the second region 150 of the tub 20. The bracket 300 may be formed in an I-shape. The bracket 300 may be formed to have an I-shaped cross-section.

The bracket 300 may be formed by bending an I-shaped flat plate into an inverted U-shape. The bracket 300 may be provided to correspond to the upper portion and the opposite side surfaces 22*a* of the tub 20. The bracket 300 may be bent in an approximately 'n' shape to correspond to the upper surface 21*a* and opposite side surfaces 22*a* of the tub 20.

The bracket 300 may include an inverted U-shaped body 320*a*. The bracket 300 may be formed in such a way that a roll-shaped flat plate is passed through a roll forming machine, the plate is cut by a predetermined length, and the cut plate is bent into an inverted U-shape. The bracket 300 may be formed by bending a plate-shaped material. The bracket 300 may include a stainless-steel material.

The bracket body 320*a* may be formed in an inverted U-shape to correspond to the upper surface 21*a* and the opposite side surfaces 22*a* of the tub 20.

The body 320*a* of the bracket 300 may further include a protrusion 320*b* protruding to prevent separation of the sealing member 130. The protrusion 320*b* may be formed to protrude inward from an end of the body 320*a*. The protrusion 320*b* of the bracket 300 may be formed by equipment such as a roll forming machine or by a mold. The sealing member 130 may be locked by the protrusion 320*b* of the bracket 300 so as to be prevented from being separated forward.

A fixing hole 320*c* may be formed in the body 320*a* of the bracket 300. A plurality of fixing holes 320*c* may be formed to be spaced apart from each other by a predetermined interval. The fixing hole 320*c* may be formed for fixing the bracket 300 to the equipment when the bracket 300 is mounted on the roll forming machine.

The bracket 300 may be fixed to the tub 20 by at least one of welding, clinching, bonding, riveting, or screwing.

In the upper panel 21 and the middle panel 22, and the lower panel 23 of the tub 20, the first regions P1 and 140 located at the first seaming line SL1 and the second seaming line SL2, and the second regions P2 and 150 provided to allow the bracket 300 to be coupled thereto may be provided.

The upper surface 21*a*, the lower surface 23*a*, and the opposite side surfaces 22*a* forming the washing chamber C of the tub 20 may be provided with the bracket coupling portion 150 for coupling the bracket 300, respectively. The bracket coupling portion 150 may be provided in the second region P2 of the tub 20. Hereinafter the second region of the tub 20 will be described as the bracket coupling portion 150.

The bracket coupling portion 150 of the tub 20 may be provided to allow the bracket 300 to be coupled and fixed thereto. The bracket coupling portion 150 of the tub 20 may be provided to protrude inward to allow the bracket 300 to be contacted and coupled thereto. The bracket coupling portion 150 may be bent inwardly of the tub 20 and extend.

The accommodation space S for accommodating the sealing member 130 may be formed between the bracket 300 coupled to the bracket coupling portion 150 and an inner surface of the tub 20. The bracket coupling portion 150 of the tub 20 may be provided to form the accommodation space S, in which the sealing member 130 is accommodated, between the bracket 300 and the tub 20 (Refer to FIGS. 9, 11 and 12).

The bracket coupling portion 150 of the tub 20 may be formed on the upper panel 21 and the middle panel 22 to correspond to the bracket 300. The bracket coupling portion 150 of the tub 20 may be formed on the lower panel 23 and the middle panel 22.

The bracket coupling portion 150 may be provided on the upper surface 21*a* and the opposite side surfaces 22*a*, which form the washing chamber C, to correspond to the bracket 300. The bracket coupling portion 150 may be formed in the front side of the upper surface 21*a* and the side surface 22*a*.

The bracket coupling portion 150 may be formed to protrude inward of the tub 20. The bracket 300 may be in contact with and fixed to a protruding inner surface of the tub 20.

The accommodation space S, in which the sealing member 130 is accommodated, may be formed between the tub 20 and the bracket 300 that is, the bracket 300 fixed to the bracket coupling portion 150. The accommodation space S between the bracket 300 and the tub 20 will be described in detail later.

The bracket coupling portion 150 or bracket coupler 150 may be integrally formed with the tub 20. The bracket coupling portion 150 may be integrally formed with the upper panel 21, the middle panel 22, and the lower panel 23.

The bracket coupling portion 150 may include a plate portion 151 protruding inward to allow the bracket 300 to be coupled thereto, and a bent portion 152 formed to be stepped from the plate portion 151 to allow the sealing member 130 to be contacted thereto. The bracket coupling portion 150 may further include a round portion 153 formed to be rounded to allow the mounting member 200, which is to be described later, to be coupled thereto.

The plate portion 151 of the bracket coupling portion 150 may be formed in a flat shape to be in surface contact with the bracket 300. The plate portion 151 of the bracket coupling portion 150 may be integrally formed with the upper panel 21 of the tub 20. The plate portion 151 of the bracket coupling portion 150 may be integrally formed with the side panel 22 of the tub 20. The plate portion 151 of the bracket coupling portion 150 may be integrally formed with the lower panel 23 of the tub 20.

The plate portion 151 of the bracket coupling portion 150 may be integrally formed with the upper surface 21*a* of the tub 20. The plate portion 151 may be integrally formed with the opposite side surfaces 22*a* of the tub 20. The bent portion 152 of the bracket coupling portion 150 may be formed to extend to be stepped from the upper surface 21*a* of the tub 20. The bent portion 152 may be provided to form a step between the opposite side surfaces 22*a* of the tub 20 and the plate portion 151. The bent portion 152 of the bracket coupling portion 150 may be formed to extend to be stepped from the opposite side surfaces 22*a* of the tub 20.

Figure 12:
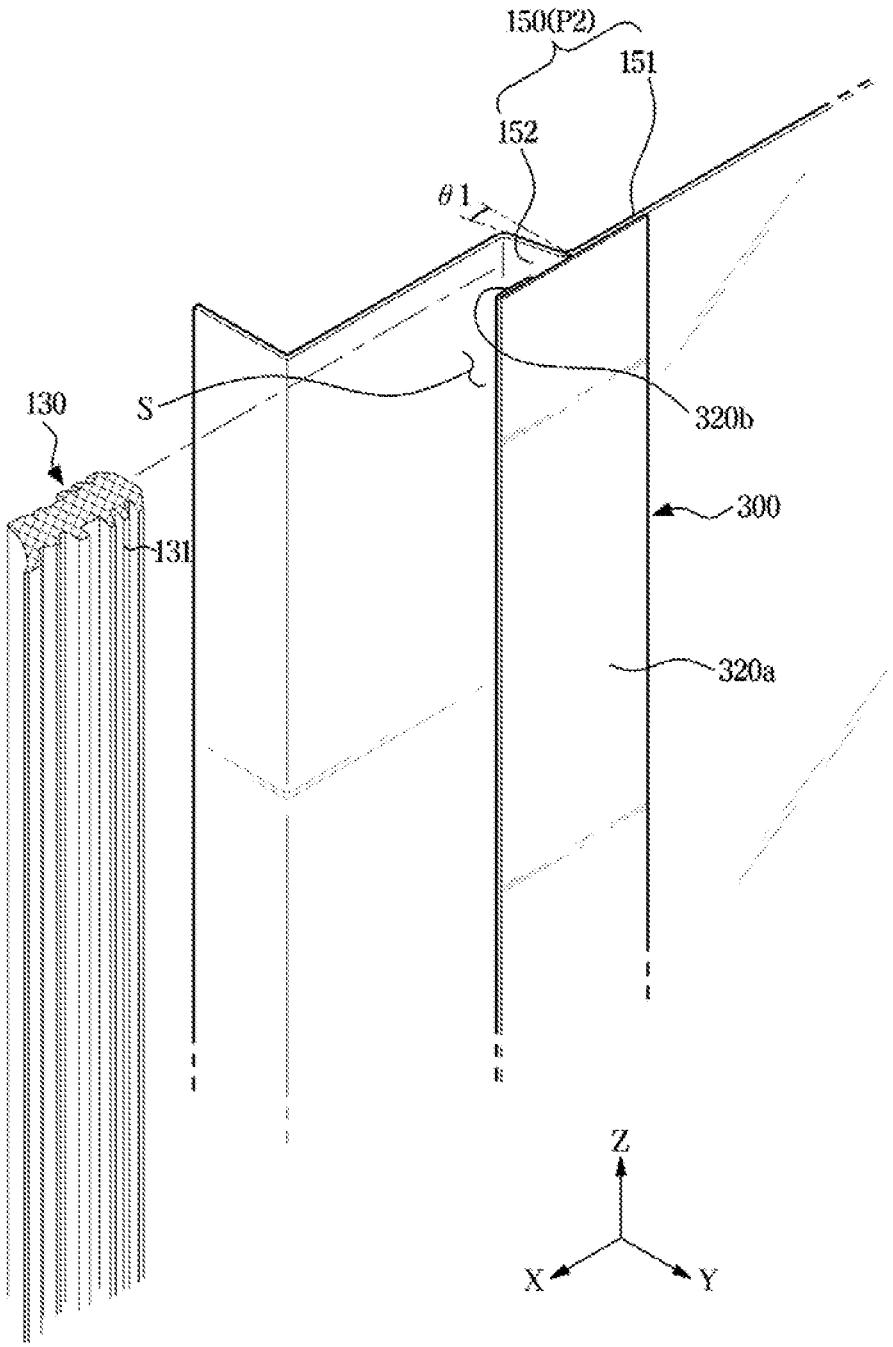
FIG. 12 is a sectional view taken along line A-A' of FIG. 11, particularly illustrating a sealing member inserted into the tub and the bracket.

The bent portion 152 of the bracket coupling portion 150 may be inclined at a predetermined angle θ1 (refer to FIG. 12). The bent portion 152 may be formed to be inclined toward the center of the tub 20. The bent portion 152 may be formed to be inclined to allow at least a portion of the sealing member 130 to be contacted and mounted thereto.

The bracket coupling portion 150 may further include the round portion 153 (FIG. 16) in which at least a portion has a curvature. The round portion 153 may be formed at opposite ends of the bracket coupling portion 150.

The round portion 153 may be formed at opposite ends of the bracket coupling portion 150 formed on the upper panel 21. The round portion 153 may be formed at opposite ends of the bracket coupling portion 150 formed on the middle panel 22. The round portion 153 may be formed on an upper portion of the bracket coupling portion 150 formed on the lower panel 23.

The round portion 153 of the bracket coupling portion 150 may be provided to allow the mounting member 200, which is to be described later, to be coupled thereto.

The first region 140 and the second region 150 of the tub 20, that is, the bracket coupling portion 150 may be provided to allow the sealing member 130 to be coupled and mounted thereto.

The first region 140 of the tub 20 may include the seaming portion 100 formed by the seaming process. The first region 140 of the tub 20 may be positioned at the first seaming line SL1 and the second seaming line SL2. The first region 140 of the tub 20 may be provided in the seaming portion 100 including the first seaming line SL1 and the second seaming line SL2.

The seaming portion 100 of the tub 20 may be formed by the upper panel 21 and the middle panel 22, and the middle panel 22 and the lower panel 23. The seaming portion 100 of the tub 20 may be formed on the same surface as the upper panel 21 and the middle panel 22, and the lower panel 23.

The second region P2 of the tub 20, that is, the bracket coupling portion 150 may be formed to protrude inward from the first region 140. Accordingly, between the bracket 300 coupled to the second region 150 of the tub 20, and the second region 150 of the tub 20, a gap G corresponding to a thickness t1 of the bent portion 152 of the second region 150 may be formed.

The dishwasher 1 may further include a mounting member 200 (also referred to as mount 200 or coupler 200) provided in the first region 140 of the tub 20 to allow the sealing member 130 to be mounted and coupled between the tub 20 and the bracket 300. The dishwasher 1 may further include the mounting member 200 provided in the seaming portion 100 of the tub 20 to allow the sealing member 130 to be mounted and coupled between the tub 20 and the bracket 300.

The mounting member 200 may be provided in the first region 140 of the tub 20. The mounting member 200 may be coupled to the seaming portion 100 of the tub 20 to prevent a gap between the tub 20 and the bracket 300.

The mounting member 200 may be provided to fill the gap G (FIG. 6) formed between the tub 20 and the bracket 300. The mounting member 200 may be provided to allow the sealing member 130 to be mounted on the accommodation space S (FIG. 9) of the tub 20.

The mounting member 200 may be symmetrically disposed on the left and right sides of the tub 20. The mounting member 200 may be respectively installed on left and right portions of the tub 20.

The mounting member 200 may be disposed in the first region 140 of the tub 20 to allow the bracket 300 to be contacted and coupled at the same position as the plate portion 151 in the second region 150 of the tub 20. The mounting member 200 may be disposed on the seaming portion 100 of the tub 20 to allow the bracket 300 to be contacted and coupled at the same position as the plate portion 151 of the tub 20.

The mounting member 200 may be disposed at a position where the seaming line SL of the tub 20 is formed.

The mounting member 200 may be coupled to the seaming portion 100 of the tub 20. The mounting member 200 may be coupled to a connection portion, that is, the first seaming portion 110, between the upper panel 21 and the middle panel 22 of the tub 20. The mounting member 200 may include a first mounting member 200*a* coupled to the first seaming portion 110 and a second mounting member 200*b* coupled to the second seaming portion 120 (FIGS. 5, 6).

The mounting member 200 may be coupled to the seaming portion 100 of the tub 20 to allow the sealing member 130 to be stably mounted between the bracket 300 coupled to the bracket coupling portion 150 of the tub 20, and the tub 20.

Figure 7:
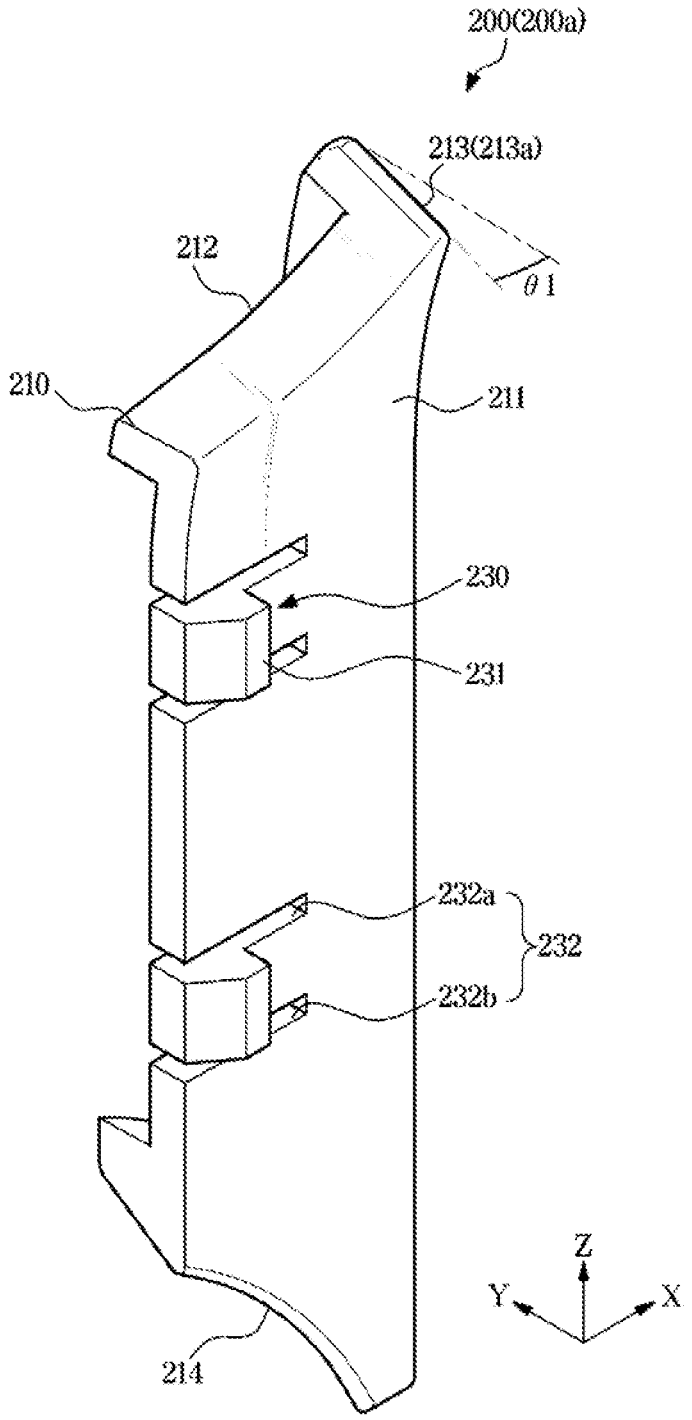
FIGS. 7 and 8 are perspective views illustrating the mounting member according to one embodiment of the present disclosure.
Figure 8:
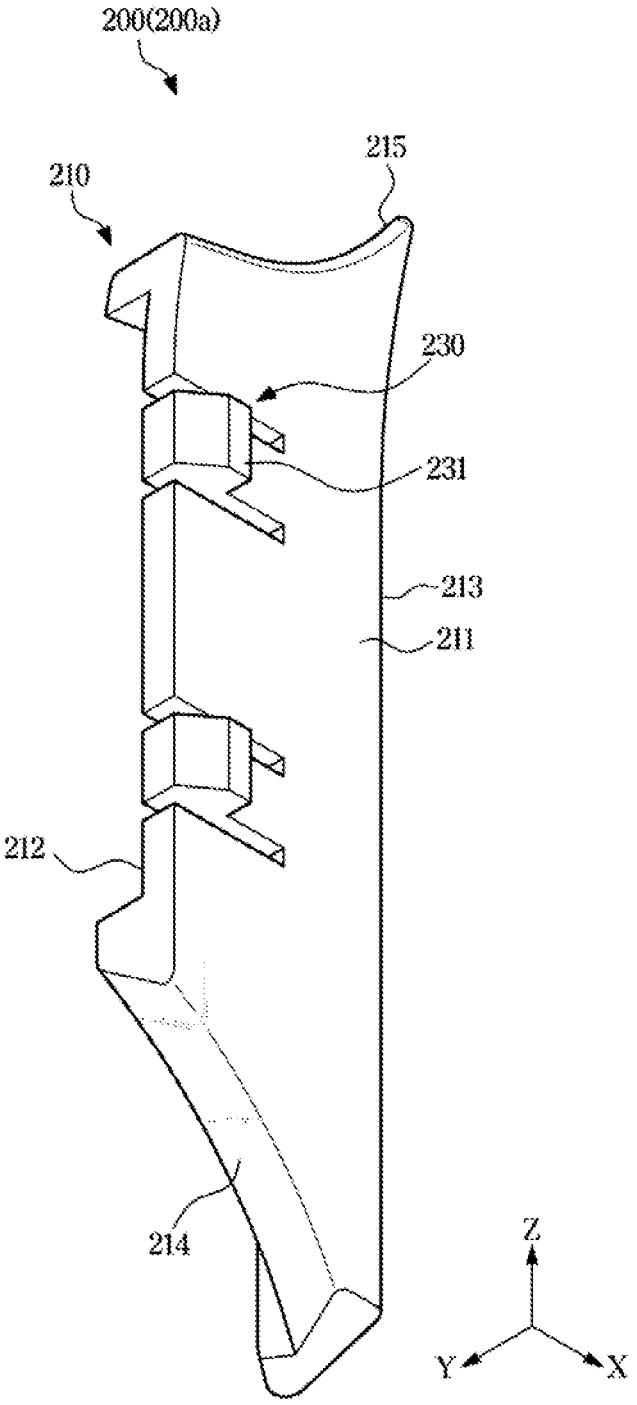

FIGS. 7 and 8 are perspective views illustrating the mounting member according to one embodiment of the present disclosure.

The first mounting member 200*a* (hereinafter referred to as 'mounting member 200') may include a mounting body 210 and a separation prevention portion 230 formed at a rear end of the mounting body 210.

The mounting member 200 may be formed of a plastic, rubber, or stainless-steel material. The mounting member 200 may be formed of an elastic material so as to be forcibly inserted between the seaming portion 100 of the tub 20 and the bracket 300.

The mounting member 200 may include the mounting body 210. The mounting body 210 of the mounting member 200 may include a flat surface portion 211 formed to be flat to be in contact with and supported by one surface of the bracket 300, an inclined surface portion 212 formed to be in contact with and supported by the inner surface of the tub 20, and a contact surface portion 213 formed in front of the flat surface portion 211 and the inclined surface portion 212.

The flat surface portion 211 of the mounting body 210 may be formed in a corresponding flat surface to be in surface contact with and supported by the bracket 300.

The contact surface portion 213 of the mounting body 210 is provided to form a front surface of the mounting member 200. The contact surface portion 213 is provided to allow at least a portion of the sealing member 130 to be contacted thereto. The contact surface portion 213 may be inclined to be similar to or equal to a shape of the bent portion 152 formed in the tub 20.

The mounting body 210 may further include a flange portion 214 formed to closely support between the bracket 300 and the tub 20. The flange portion 214 may be provided to support the mounting member 200 to prevent the mounting member 200 from being separated toward the inside of the tub 20. The flange portion 214 may be formed in a corresponding shape to allow the mounting member 200 to be more closely attached between the bracket 300 and the seaming portion 100 of the tub 20. The flange portion 214 may be formed in a lower portion of the mounting body 210. The flange portion 214 may be formed in a shape corresponding to the bracket coupling portion 150 of the tub 20. The flange portion 214 may be formed in a shape corresponding to the bent portion 152 of the bracket coupling portion 150. The flange portion 214 may be formed in a shape corresponding to the round portion 153 of the bracket coupling portion 150. The flange portion 214 may be formed to correspond to a curvature of the corresponding round portion 153. It is appropriate that the flange portion 214 is formed to correspond to the shape of the bracket coupling portion 150 to prevent the mounting member 200 coupled to the seaming portion 100 from being moved in the front and rear direction of the tub 20.

The mounting body 210 may further include a wing portion 215 (FIG. 8) formed to closely support between the bracket 300 and the tub 20. The wing portion 215 may be formed in an upper portion of the mounting body 210. The wing portion 215 may be formed in a shape corresponding to the bracket coupling portion 150 of the tub 20. The wing portion 215 may be formed in a shape corresponding to the bent portion 152 of the bracket coupling portion 150. The wing portion 215 may be formed in a shape corresponding to the round portion 153 of the bracket coupling portion 150. The wing portion 215 may be formed to correspond to the curvature of the corresponding round portion 153. It is appropriate that the wing portion 215 is formed to correspond to the shape of the bracket coupling portion 150 so as to prevent the mounting member 200 coupled to the seaming portion 100 from being moved in the front and rear direction of the tub 20.

By the flange portion 214 and the wing portion 215 of the mounting body 210, it is possible to prevent or inhibit the mounting member 200 from being moved and separated to the inside of the tub 20.

The mounting member 200 may include the contact surface portion 213 provided to form a front surface. The contact surface portion 213 may be formed on the front surface of the mounting body 210. The contact surface portion 213 may be formed to correspond to the bent portion 152 of the tub 20. The contact surface portion 213 may further include an inclined surface 213*a* formed to be inclined at a predetermined angle θ1 to correspond to an inclination of the bent portion 152. It is appropriate that the contact surface portion 213 of the mounting member 200 is positioned on the same line as the bent portion 152 of the second region 150 to allow the sealing member 130 to be mounted thereto.

The mounting member 200 may be positioned on the same plane as the bent portion 152 of the bracket coupling portion 150 so as to be positioned at the same position as the accommodation space S in which the sealing member 130 is accommodated. Therefore, the sealing member 130 may have the same sealing force in the accommodation space S in which the sealing member 130 is accommodated.

The sealing member 130 may be accommodated in the accommodation space S, which is formed by the tub 20 and the bracket 300, by the mounting member 200, and thus the sealing member 130 may generate a constant sealing force to perform stable sealing.

In the mounting member 200, the contact surface portion 213 may be formed to be flat so as to allow the rear end of the sealing member 130 to be contacted thereto. The mounting member 200 may further include the separation prevention portion 230 for preventing separation.

The separation prevention portion 230 may be formed to protrude from the rear end of the mounting body 210. The separation prevention portion 230 may be formed by protruding at least a portion of the mounting body 210. The separation prevention portion 230 may be formed to protrude from the rear end of the flat surface portion 211 of the mounting body 320*a*. The separation prevention portion 230 may be formed at the rear end of the flat surface portion 211 to be locked and supported by the bracket 300 supported by the flat surface portion 211. The separation prevention portion 230 may be formed to be locked by the rear end of the bracket 300 supported by the flat surface portion 211.

The separation prevention portion 230 may further include a hook 231. The hook 231 may be formed at the rear end of the mounting body 210 of the mounting member 200. The hook 231 may be provided to be elastically supported by a pair of cutouts 232*a* and 232*b* formed by cutting at least a portion of the rear end of the mounting body 210. The hook 231 may be formed to protrude from the rear end of the flat surface portion 211 of the mounting body 210. The hook 231 may be locked at the rear end of the bracket 300, which is in contact with and supported by the flat surface portion 211, so as to prevent the mounting member 200 from being separated forward.

In the embodiment of the present disclosure, a case in which the separation prevention portion 230 of the mounting member 200 includes two hooks 231 has been described as an example, but is not limited thereto. For example, the number of hooks may vary according to the size and shape of the mounting member.

Figure 9:
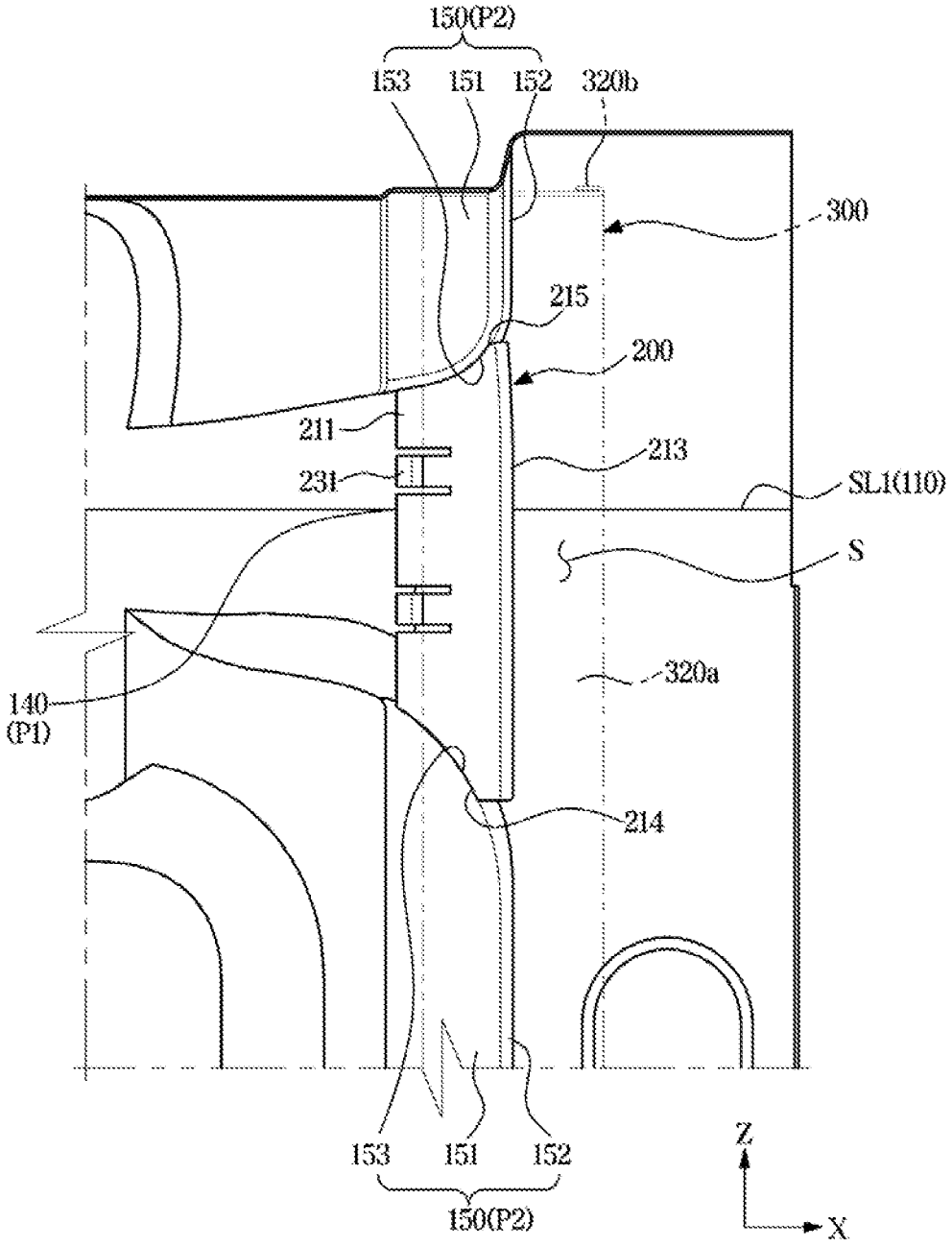
FIG. 9 is a side view illustrating a mounting member mounted to a second region of the tub according to one embodiment of the present disclosure.
Figure 10:
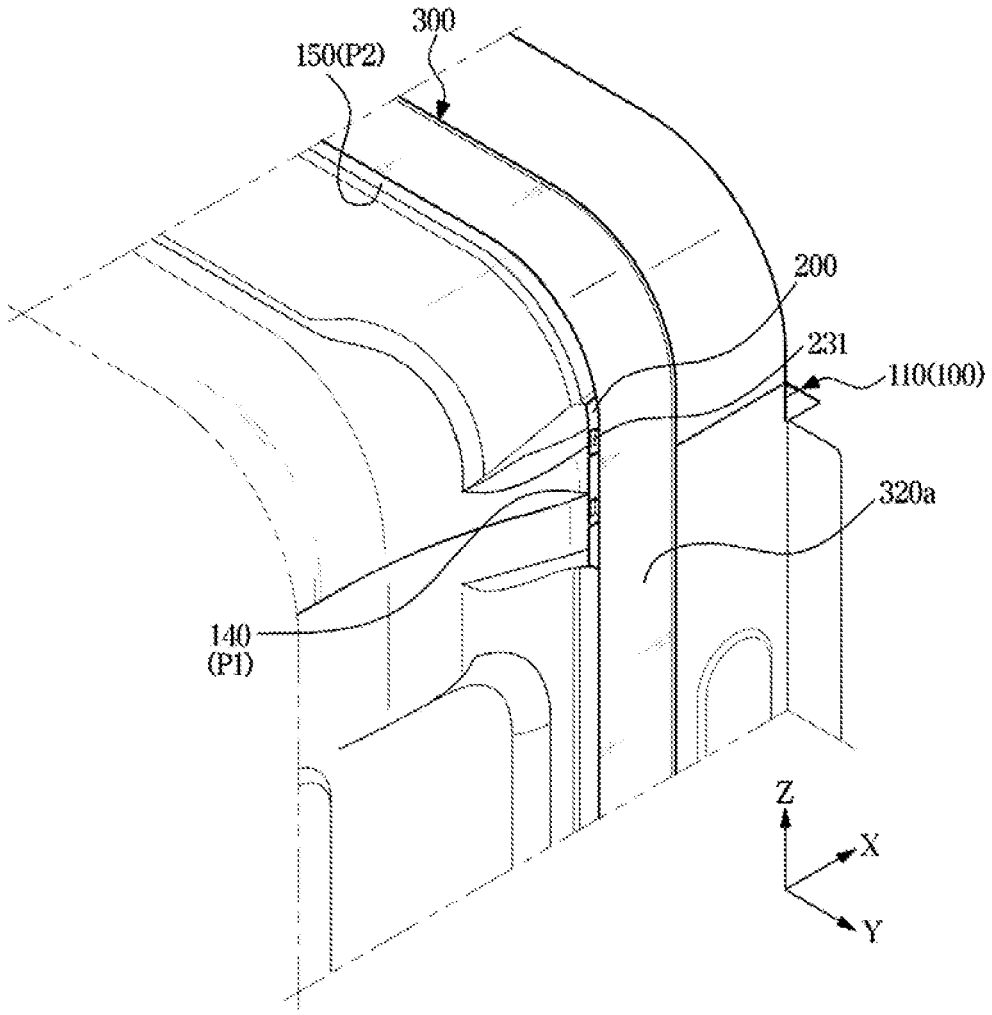
FIG. 10 is a perspective view illustrating the bracket and the mounting member coupled to the tub according to one embodiment of the present disclosure.
Figure 11:
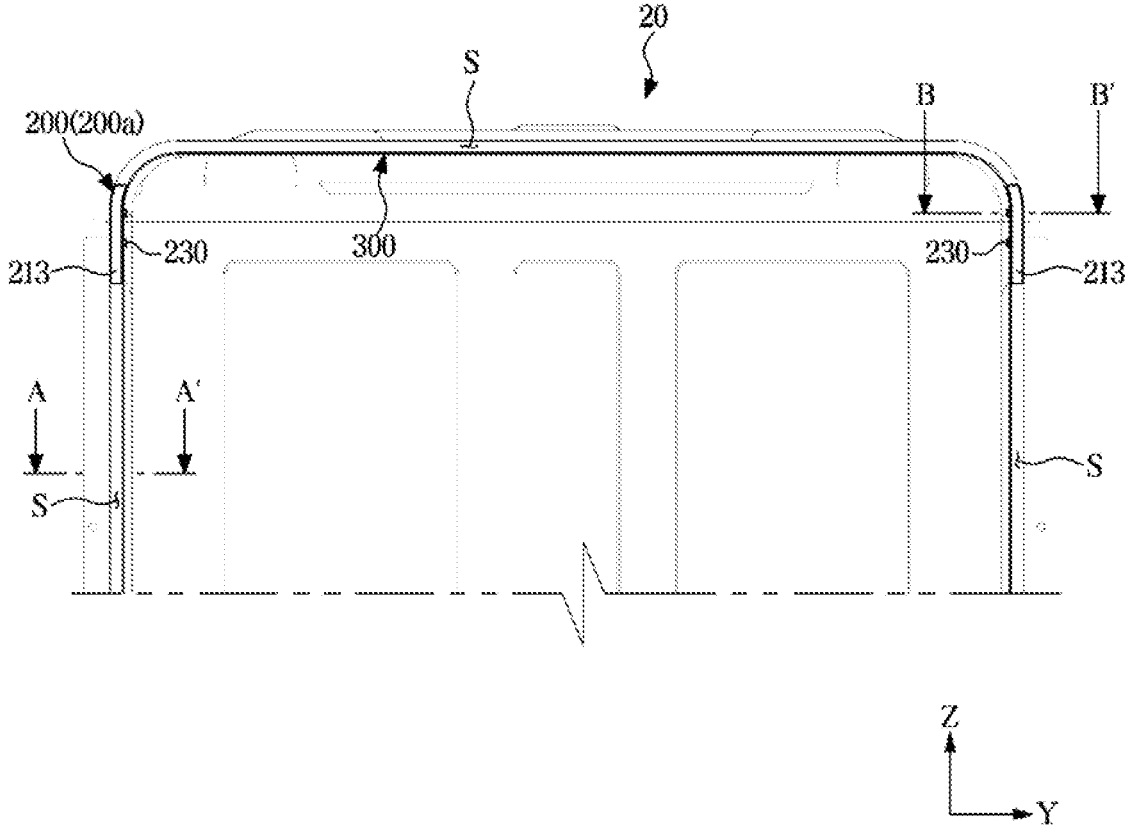
FIG. 11 is a front view illustrating the bracket coupled to a first region of the tub and the mounting member coupled to a first seaming portion according to one embodiment of the present disclosure.

FIG. 9 is a side view illustrating a mounting member mounted to a second region of the tub according to one embodiment of the present disclosure, FIG. 10 is a perspective view illustrating the bracket and the mounting member coupled to the tub according to one embodiment of the present disclosure, and FIG. 11 is a front view illustrating a bracket coupled to a first region of the tub and a mounting member coupled to a first seaming portion according to one embodiment of the present disclosure. A description of the content the same as the above-described content will be omitted.

As illustrated in FIGS. 9 to 11, the mounting member 200 may be provided to be coupled to the seaming portion 100 of the tub 20. The mounting member 200 is coupled to the seaming portion 100 so as to fill a gap between the bracket coupling portion 150 and a bracket coupling portion 150 adjacent thereto.

It is appropriate that the mounting member 200 is formed in a shape corresponding to the seaming portion 100 of the tub 20. The mounting body 210 of the mounting member 200 may include the inclined surface portion 212 formed to correspond to the seaming portion 100 of the tub 20. The inclined surface portion 212 of the mounting member 200 may be in contact with and supported by the seaming portion 100 of the tub 20, and the flat surface portion 211 may be in contact with and supported by the bracket 300 coupled to the bracket coupling portion 150.

The hook 231 of the separation prevention portion 230 may be locked by the bracket 300 to prevent the mounting member 200 from being separated forward.

The flange portion 214 and the wing portion 215 of the mounting member 200 may be provided to correspond to the round portion 153 of the bracket coupling portion 150, respectively, so as to prevent the mounting member 200 from being moved to the inside of the tub 20.

The sealing member 130 disposed between the tub 20 and the door 11 of the dishwasher 1 may be inserted into and coupled to the accommodation space S between the bracket 300, which is fixed to the second region 150 of the tub 20, and the tub 20.

The sealing member 130 may be inserted into the space between the tub 20 and the bracket 300 in response to the bracket 300 being in contact with and fixed to the plate portion 151 that protrudes inward by the bent portion 152 formed to be stepped from the opposite side surfaces 22*a* of the tub 20.

Figure 13:
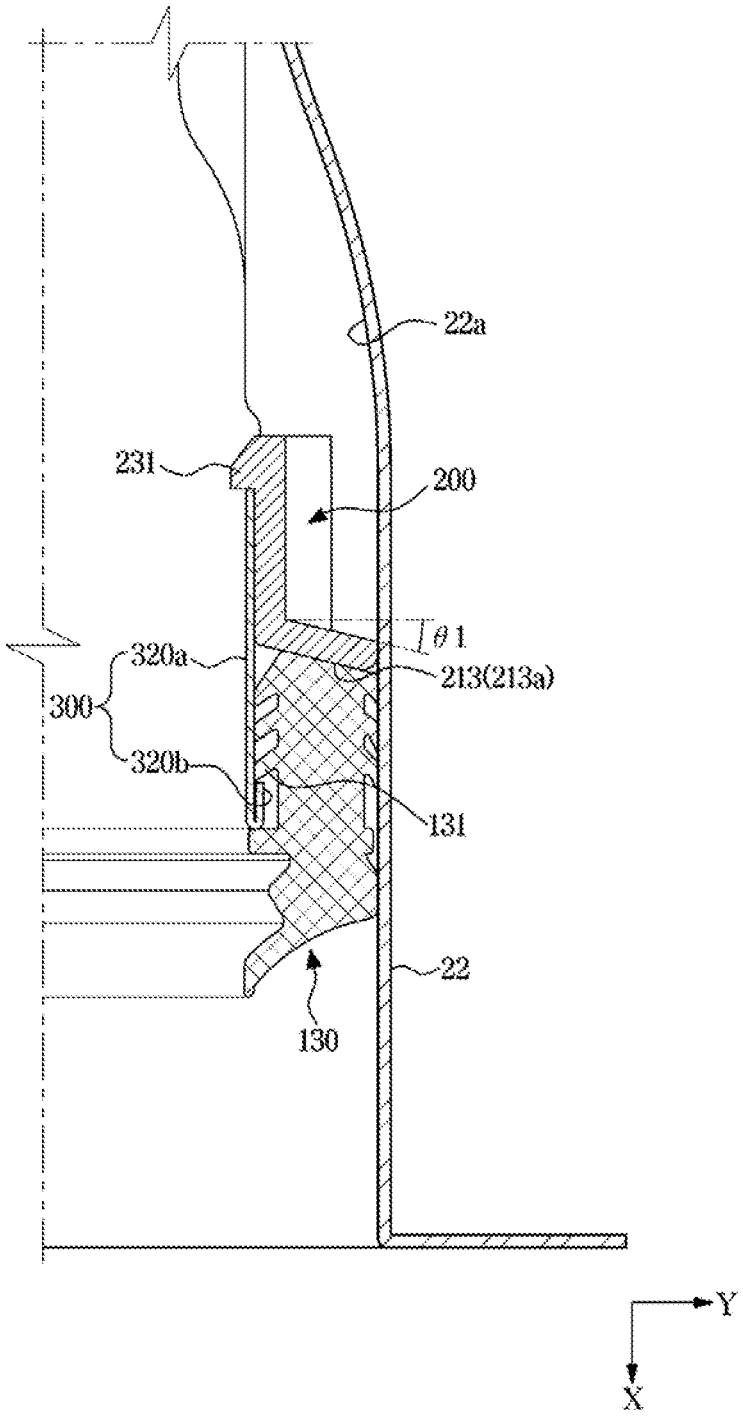
FIG. 13 is a sectional view taken along line B-B' of FIG. 11, particularly illustrating a sealing member mounted to the tub, the bracket, and the mounting member.

FIG. 12 is a sectional view taken along line A-A' of FIG. 11, particularly illustrating a sealing member inserted into the tub and the bracket, and FIG. 13 is a sectional view taken along line B-B' of FIG. 11, particularly illustrating a sealing member mounted to the tub, the bracket, and the mounting member. A description of the content the same as the above-described content will be omitted.

As illustrated in FIGS. 12 and 13, the sealing member 130 may be inserted into between the bracket 300, which is fixed to the bracket coupling portion 150 of the tub 20, and the inner side surface 22*a* of the tub 20.

Particularly, the sealing member 130 may be inserted into the accommodation space S formed between the bracket 300 fixed to the plate portion 151 of the bracket coupling portion 150 of the tub 20 and the side surface 22*a* of the tub 20.

The sealing member 130 may be mounted on the tub 20 by the bent portion 152 of the bracket coupling portion 150. The bent portion 152 of the bracket coupling portion 150 may be formed to be inclined at a predetermined angle θ1 toward the center of the tub 20.

The contact surface portion 213 formed on the front surface of the mounting member 200 may be formed at a predetermined angle θ1 to correspond to the bent portion 152 of the tub 20. The angle θ1 of the bent portion 152 of the bracket coupling portion 150 and the angle θ1 of the contact surface portion 213 of the mounting member 200 may be formed to be the same. Accordingly, the sealing member 130 mounted on the bent portion 152 of the bracket coupling portion 150 may be stably mounted on the contact surface portion 231 of the mounting member 200 at the same position and angle.

The sealing member 130 may be formed of a flexible material. The sealing member 130 may be formed of a flexible and elastic material. For example, the sealing member 130 may be formed of a rubber, silicone, or the like.

The sealing member 130 may include a plurality of wings 131 for sealing around an outer circumferential surface. In the embodiment of the present disclosure, a case, in which the number of wings of the sealing member 130 is four, is described as an example, but is not limited thereto. For example, the wing may vary according to the size and shape of the sealing member.

The sealing member 130 may be locked by the protrusion 320*b* of the bracket 300 to prevent the sealing member 130 from being separated forward. Particularly, the sealing member 130 mounted in the accommodation space S between the tub 20 and the bracket 300 may be locked by the protrusion 320*b* formed at the outer end of the bracket 300 to prevent the sealing member 130 from being separated forward. The protrusion 320*b* of the bracket 300 may be locked to the wing 131 of the sealing member 130 so as to prevent the sealing member 130 from being separated forward.

Hereinafter a method of manufacturing the dishwasher 1 according to one embodiment of the present disclosure will be briefly described.

The first panel and the second panel are coupled by the seaming process to form the seaming portion 100. For example, the upper panel 21 and the middle panel 22 are coupled by the seaming process to form the first seaming portion 110, and the middle panel 22 and the lower panel 23 are coupled by the seaming process to form the second seaming portion 120, thereby forming to the tub 20.

In the first panel and the second panel forming the tub 20, the bracket coupling portion 140 protruding inwardly is provided in a region except the seaming portion 100.

Next, the bracket 300 is coupled to the bracket coupling portion 140 to form the accommodation space S between the inner surface of the tub 20 and the bracket 300.

In response to the bracket 300 bring coupled to the bracket coupling portion 140 of the tub 20, the mounting member 200 may be coupled to the seaming portion 100. In this case, the mounting member 200 may be provided to correspond to a protrusion height of the bracket coupling portion 140.

Next, the sealing member 130 may be inserted into the accommodation space S to be supported by the bracket coupling portion 140 and the mounting member 200.

Figure 14:
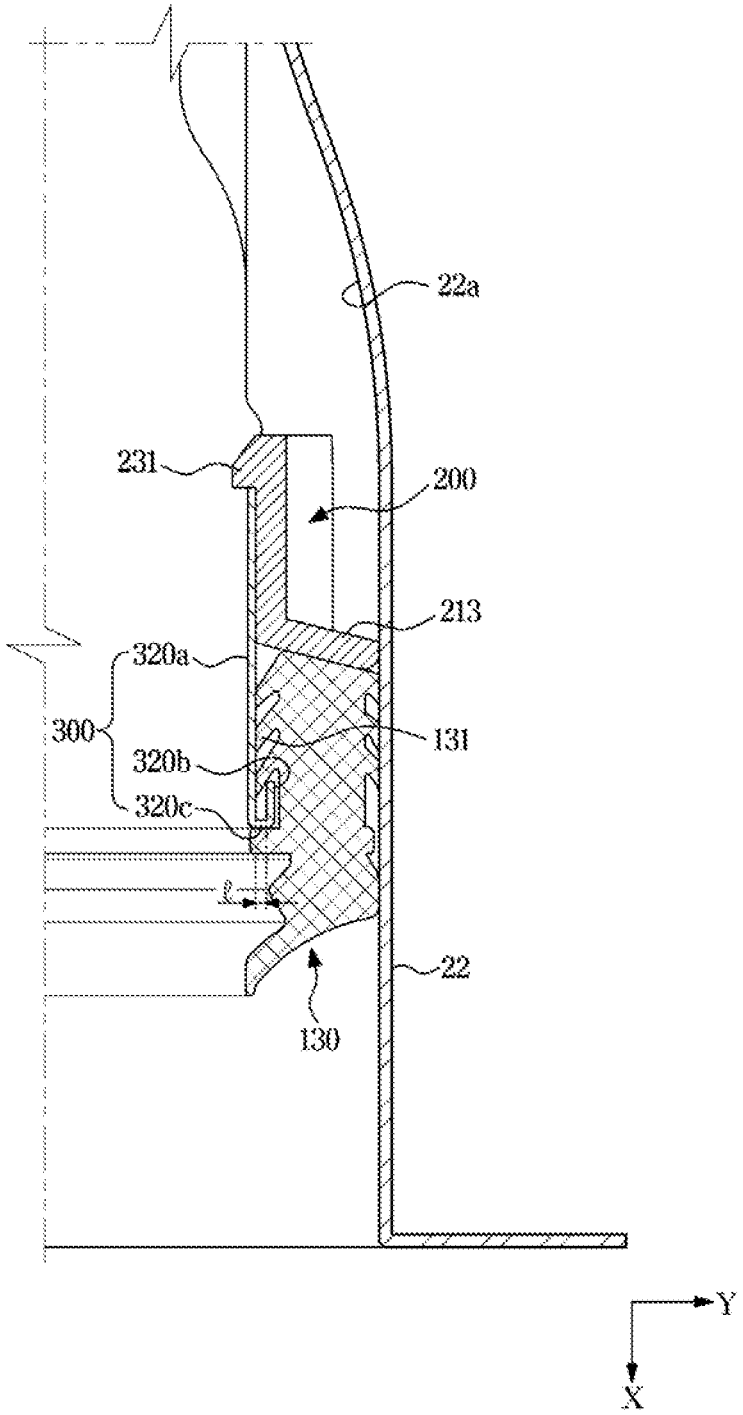
FIG. 14 is a cross-sectional view illustrating a protrusion of a bracket according to another embodiment of the present disclosure.

FIG. 14 is a cross-sectional view illustrating a protrusion of a bracket according to another embodiment of the present disclosure. A description of the content the same as the above-described content will be omitted.

As illustrated in FIG. 14, a protrusion 320*b* of a bracket 300 may be spaced apart from a body 320*a*.

The protrusion 320*b* of the bracket 300 may be formed to be spaced apart from the body 320*a* by a predetermined distance 1. The bracket 300 may further include an extension portion 320*c* extending from an end of the body 320*a* to prevent separation of the sealing member 130, and the protrusion 320*b* formed by bending from the extension portion 320*c*. The extension portion 320*c* of the bracket 300 may be formed to extend outwardly from the end of the body 320*a*. By the extension portion 320*c* and the protrusion 320*b* of the bracket 300, it is possible to prevent the sealing member 130, which is inserted between the bracket 300 and the tub 20, from being moved and separated forward.

A separation prevention portion 320 of the mounting member 200 may be locked by the other end of the bracket 300. A hook 231 of the separation prevention portion 320 may be locked by the other end of the bracket 300 so as to prevent the mounting member 200 from being moved and separated forward.

A sealing member 130 may be inserted into the accommodation space S between the mounting member 200 inserted into the seaming portion 100 of the tub 20, the bracket 300, and the tub 20. The mounting member 200 inserted into the seaming portion 100 of the tub 20 is provided to prevent a gap from being formed between the bracket 300 and the inner surface of the tub 20.

A rear end of the sealing member 130 may be in contact with the contact surface portion 213 of the mounting member 200 inserted into the seaming portion 100 of the tub 20, and thus one side of the sealing member 130 may be in contact with the bracket 300 and the other side of the sealing member 130 may be in contact with and coupled to the opposite side surfaces 22*a* of the tub 20.

Figure 15:
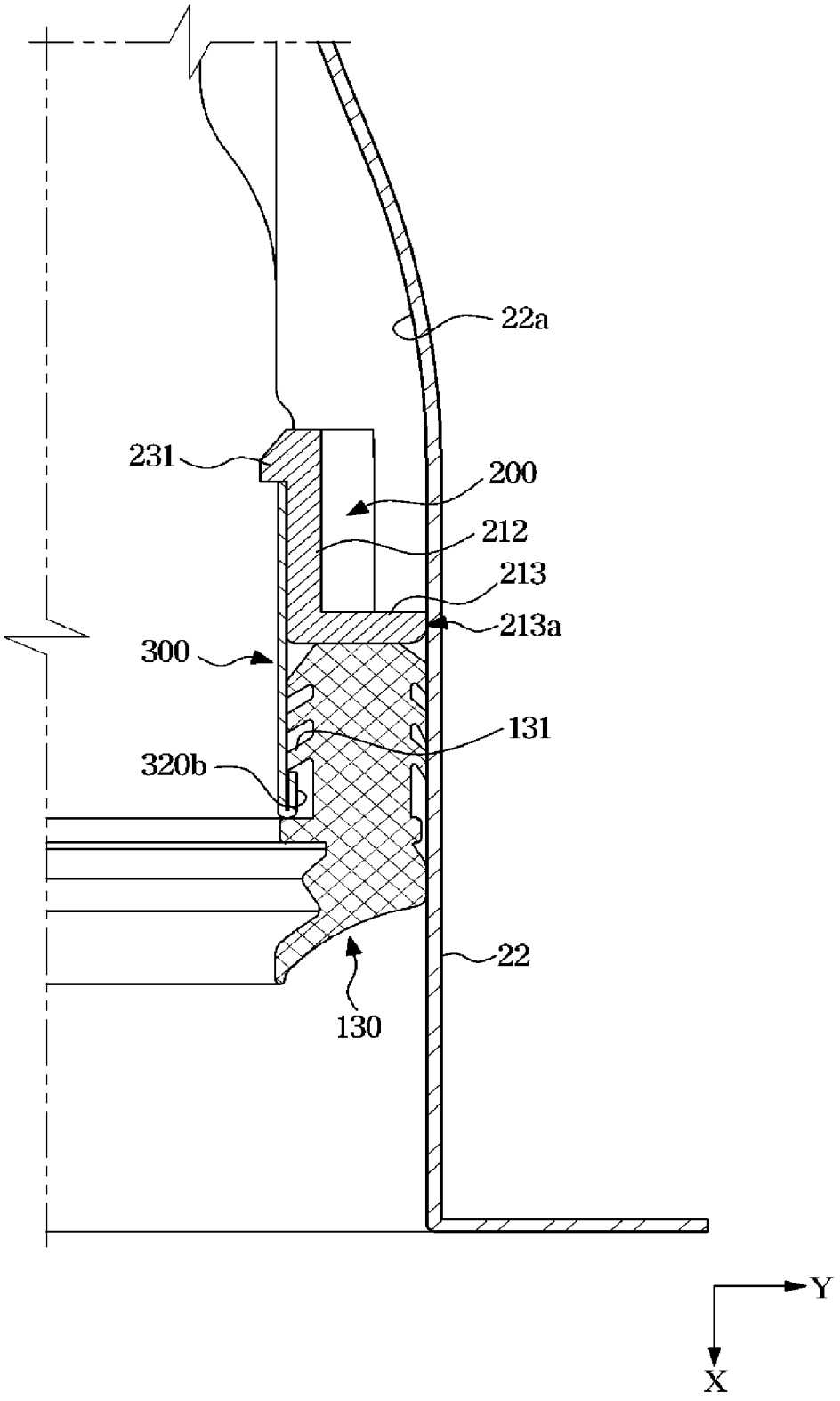
FIG. 15 is a view illustrating a mounting member coupled to a tub according to another embodiment of the present disclosure.

FIG. 15 is a view illustrating a mounting member coupled to a tub according to another embodiment of the present disclosure. A description of the content which is the same as the above-described content will be omitted.

As illustrated in FIG. 15, a mounting member 200 may include a mounting body 210 and a separation prevention portion 231 formed at a rear end of the mounting body 210.

The mounting member 200 may be formed of a plastic, rubber, or stainless-steel material. The mounting body 210 of the mounting member 200 may include a flat surface portion 213 formed to be flat to be in contact with and supported by one surface of the bracket 300, an inclined surface portion 212 formed to be in contact with and supported by an inner surface of the tub 20, and a contact surface portion 213*a* formed in front of the flat surface portion 213 and the inclined surface portion 212.

The contact surface portion 213*a* formed on the front surface of the mounting member 200 may be flatly formed to be parallel to the front surface of the tub 20. The contact surface portion 213*a* of the mounting member 200 may be formed to correspond to the bent portion 152 of the tub 20. The flat surface portion 213 of the mounting member 200 may be provided to allow the sealing member 130 to be stably mounted thereon.

The bent portion 152 of the bracket coupling portion 150 and the contact surface portion 213*a* of the mounting member 200 may be formed to be positioned on the same line.

Accordingly, the sealing member 130 mounted on the bent portion 152 of the tub 20 may be coupled and stably sealed under the same conditions such as the same position and angle as the flat surface portion 213 of the mounting member 200.

Figure 16:
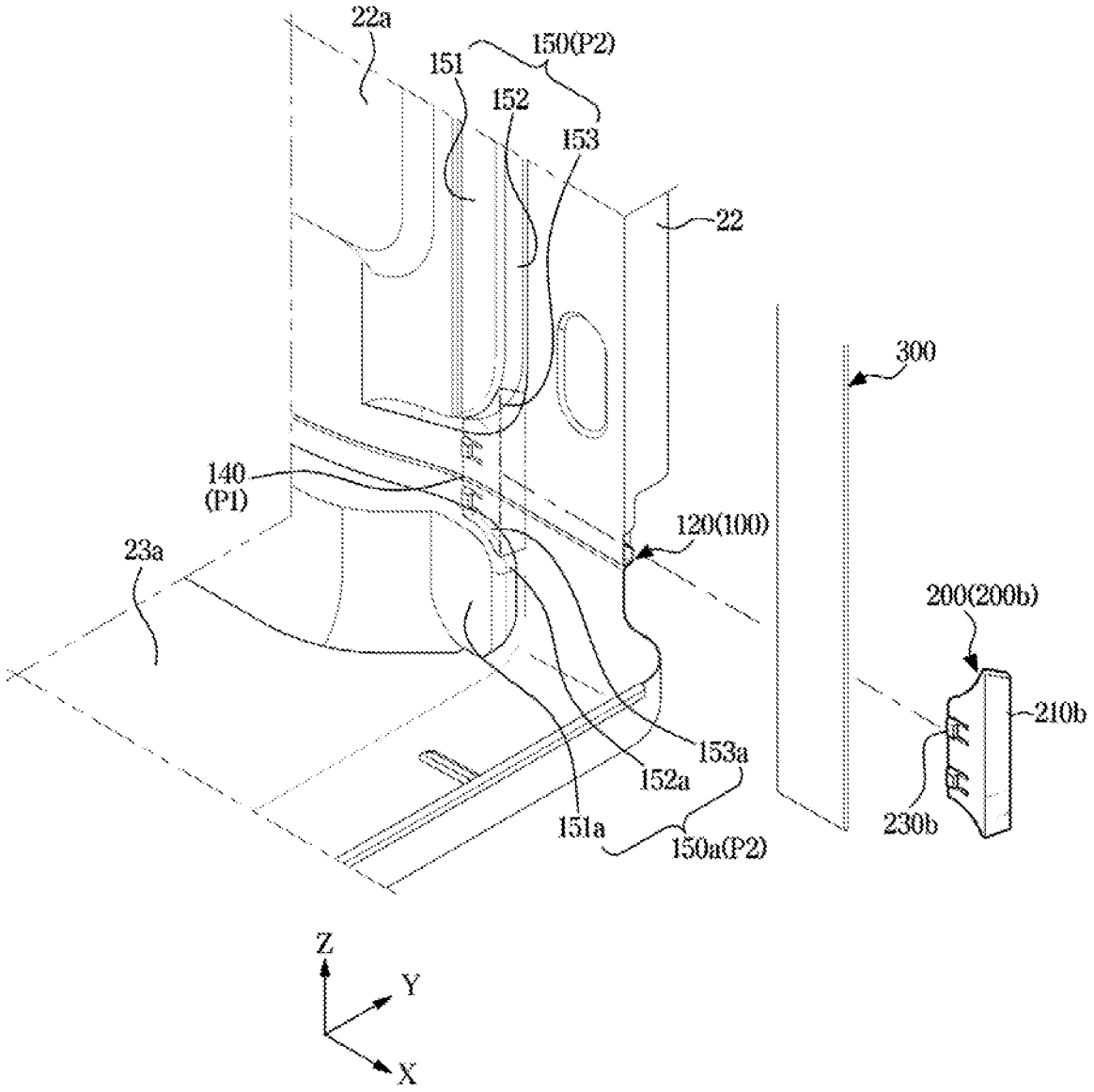
FIG. 16 is a view illustrating a mounting member coupled to a second seaming portion of a tub according to another embodiment of the present disclosure.

FIG. 16 is a view illustrating a mounting member 200 coupled to a second seaming portion of a tub according to another embodiment of the present disclosure. A description of the content which is the same as the above-described content will be omitted.

As illustrated in FIG. 16, a mounting member 200 may further include a second mounting member 200*b* installed on a second seaming portion 120 of a tub 20. The second seaming portion 120 of the tub 20 may be formed by a middle panel 22 and a lower panel 23. The second seaming portion 120 of the tub 20 may be formed on a second seaming line SL2.

The second seaming portion 120 of the tub 20 may include a first region 140. The second seaming portion 120 of the tub 20 may include the first region 140 for mounting the second mounting member 200*b*. The tub 20 may further include the second mounting member 200*b* coupled to the first region 140 positioned on the second seaming line SL2.

The second seaming portion 120 of the tub 20 may be formed by coupling the middle panel 22 to the lower panel 23. The first region 140 may be formed by a second region 150 formed on the middle panel 22 and a second region 150*a* formed on the lower panel 23.

The second region 150*a* formed on the lower panel 23 may extend integrally from a lower surface 23*a*. In order to form opposite side surfaces 22*a* of the tub 20, the second region 150*a* of the lower panel 23 may be bent upward from opposite ends of the lower surface 23*a* and extend. A bracket coupling portion 150*a* formed on the lower panel 23 may be formed in the front and rear direction of the tub 20. The bracket coupling portion 150*a* formed on the lower panel 23 may include a plate portion 151*a* protruding inward to allow a bracket 300 to be coupled thereto, a bent portion 152*a* formed to be stepped from the plate portion 151 to allow a sealing member 130 to be contacted thereto, and a round portion 153*a* formed to be rounded to allow the second mounting member 200*b* to be coupled thereto. The round portion 153*a* of the bracket coupling portion 150*a* may be formed at a front end of the tub 20.

Figure 17:
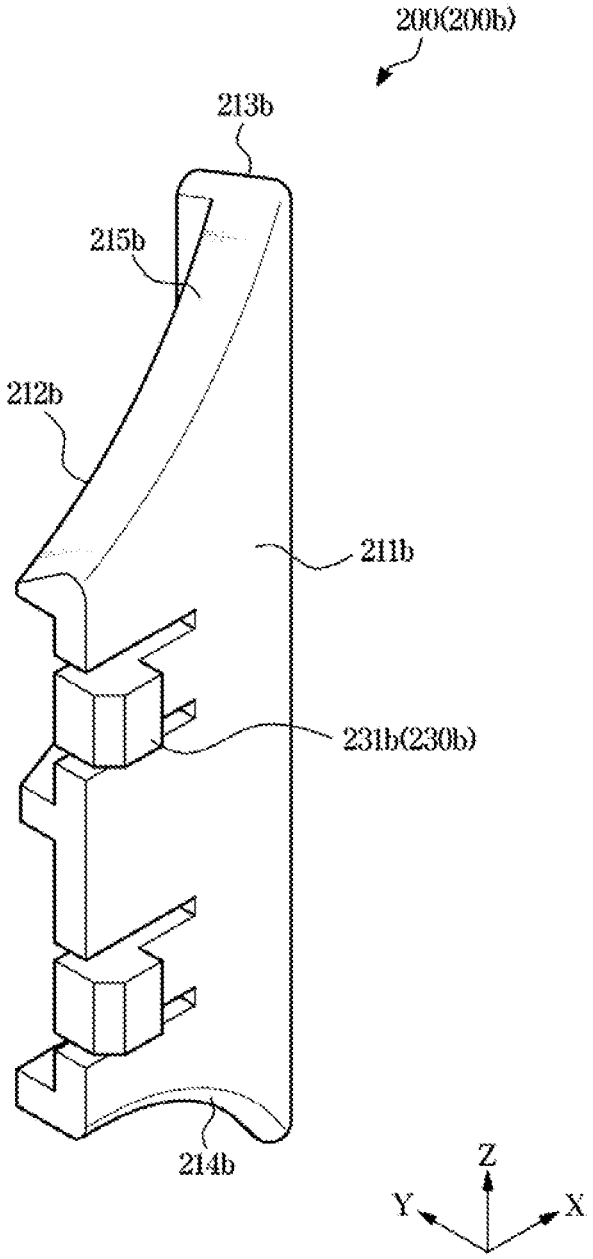
FIGS. 17 and 18 are perspective views illustrating a second mounting member shown in FIG. 16.
Figure 18:
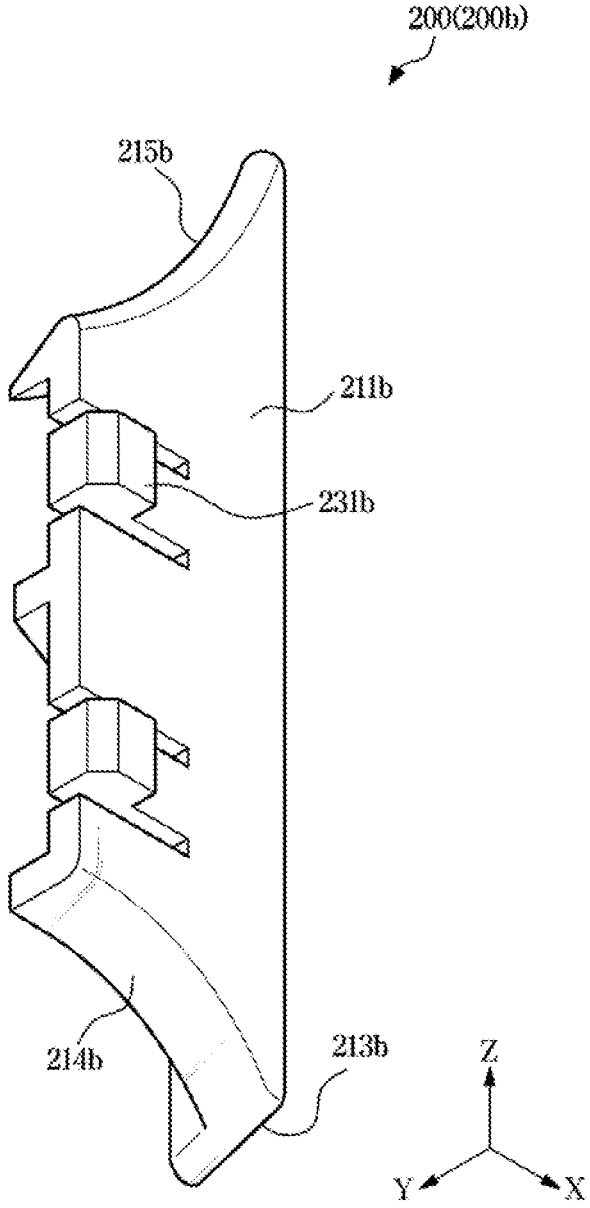

FIGS. 17 and 18 are perspective views illustrating a second mounting member shown in FIG. 16. A description of the content which is the same as the above-described content will be omitted.

As illustrated in FIGS. 17 and 18, the second mounting member 200*b* may include a mounting body 211*b*, and a separation prevention portion 231*b* formed at a rear end of the mounting body 210*b*.

The second mounting member 200*b* may be formed to correspond to the second seaming portion 120 of the tub 20. The second mounting member 200*b* may be formed to correspond to the first region 140 of the second seaming portion 120. An exterior of the second mounting member 200*b* may be formed by the mounting body 211*b*.

The mounting body 211*b* may include a flat surface portion formed to be flat to be in contact with and supported by one surface of the bracket 300, an inclined surface portion 212*b* formed to be in contact with and supported by an inner surface of the tub 20, and a contact surface portion 213*b* formed in front of the flat surface portion 211*b* and the inclined surface portion 212*b*.

The contact surface portion 213*b* of the mounting body 211*b* may be inclined to be similar to or equal to the shape of the bent portion 152 formed in the tub 20. The mounting body 210*b* may further include a flange portion 214*b* formed to closely support between the bracket 300 and the tub 20. The flange portion 214*b* may be provided to support the second mounting member 200*b* to prevent the second mounting member 200*b* from being separated toward the inside of the tub 20.

The flange portion 214*b* may be formed in a corresponding shape to allow the second mounting member 200*b* to be more closely attached between the bracket 300 and the first region 140 of the tub 20. The flange portion 214*b* may be formed in a lower portion of the mounting body 211*b*. The flange portion 214*b* may be formed in a shape corresponding to the second region 150*a* of the tub 20. The flange portion 214*b* may be formed in a shape corresponding to a bent portion 152 of the second region 150*a*. The flange portion 214*b* may be formed in a shape corresponding to a round portion 153 of a first region 140*a*. The flange portion 214*b* may be formed to correspond to the curvature of the corresponding round portion 143*a*.

The mounting body 211*b* may further include a wing portion 215*b* formed to closely support between the bracket 300 and the tub 20. The wing portion 215*b* may be formed in an upper portion of the mounting body 211*b*. The wing portion 215*b* may be formed in a shape corresponding to the second region 150 of the tub 20. The wing portion 215*b* may be formed in a shape corresponding to the bent portion 152 of the second region 150. The wing portion 215*b* may be formed in a shape corresponding to the round portion 153 of the second region 150. The wing portion 215*b* may be formed to correspond to the curvature of the corresponding round portion 153.

By the flange portion 214*b* and the wing portion 215*b* of the mounting body 211*b*, it is possible to prevent the second mounting member 200*b* from being moved and separated to the inside of the tub 20.

The second mounting member 200*b* may include a contact surface portion 213*b* provided to form a front surface. The contact surface portion 213*b* may be formed on the front surface of the mounting body 210. The contact surface portion 213*b* may be formed to correspond to a bent portion 152*a* of the second region 150 of the tub 20. The contact surface portion 213*b* may be formed to be inclined at a predetermined angle θ1 to correspond to an inclination of the bent portion 152*a*.

The second mounting member 200*b* may further include a separation prevention portion 231*b* for preventing separation. The separation prevention portion 231*b* may be formed to protrude from the rear end of the mounting body 211*b*. The separation prevention portion 231*b* may be formed at the rear end of the flat surface portion 211*b* to be locked by the rear end of the bracket 300. The separation prevention portion 231*b* may further include a hook. The hook may be locked by the rear end of the bracket 300 to prevent the second mounting member 200*b* from being separated forward.

Figure 19:
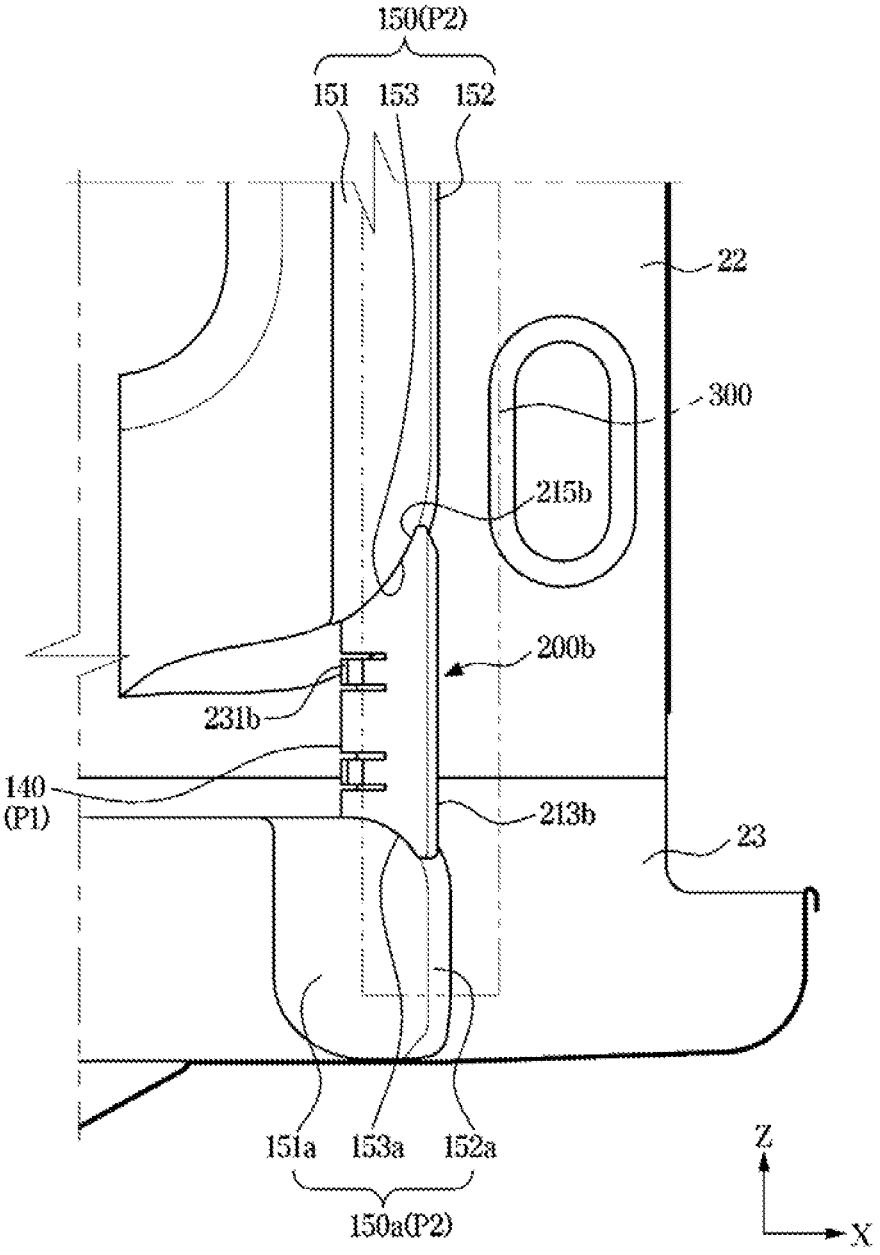
FIG. 19 is a view illustrating a state in which the second mounting member shown in FIG. 16 is coupled to the second seaming portion of the tub.
Figure 20:
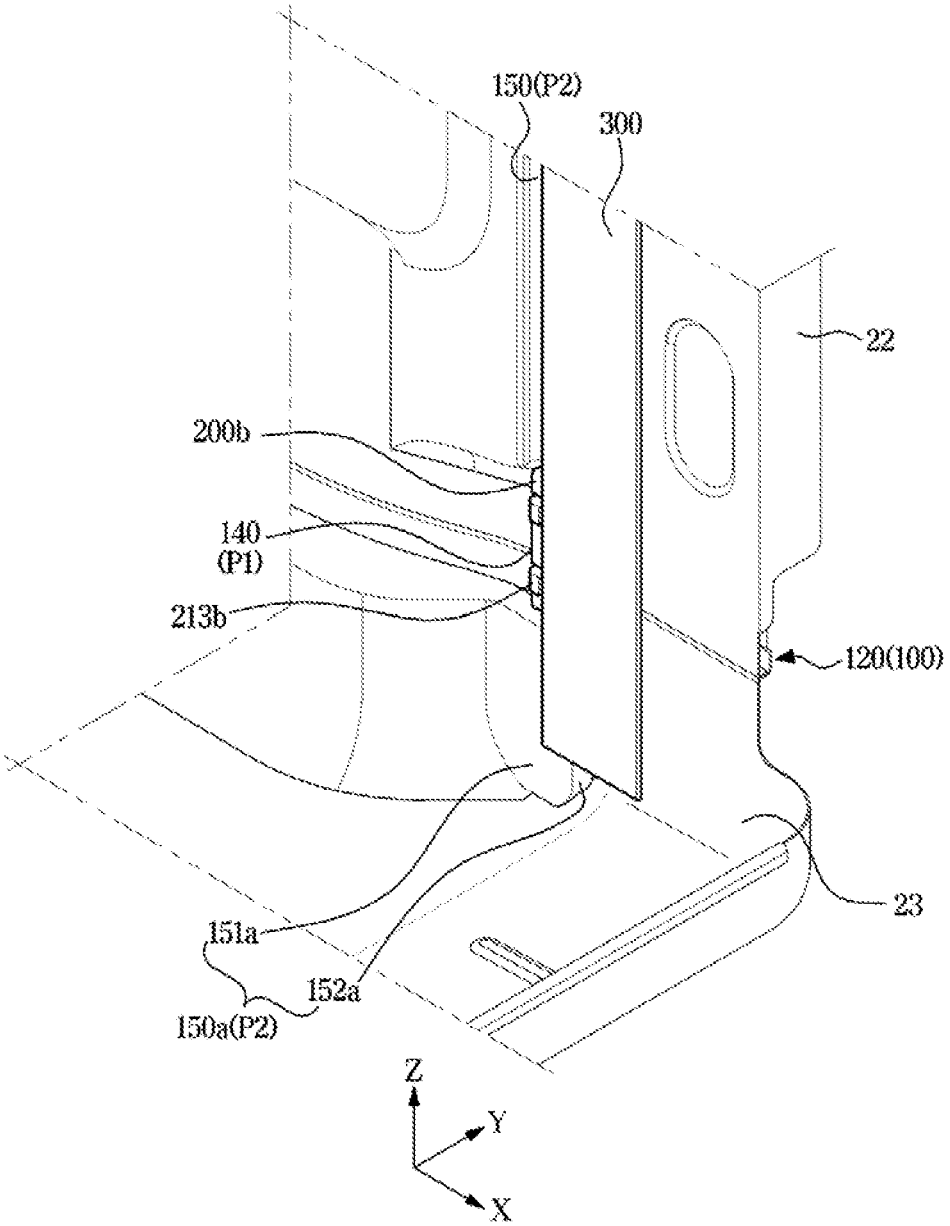
FIG. 20 is a view illustrating a bracket coupled to a first region of the tub and a mounting member coupled to the second seaming portion according to another embodiment of the present disclosure.
Figure 21:
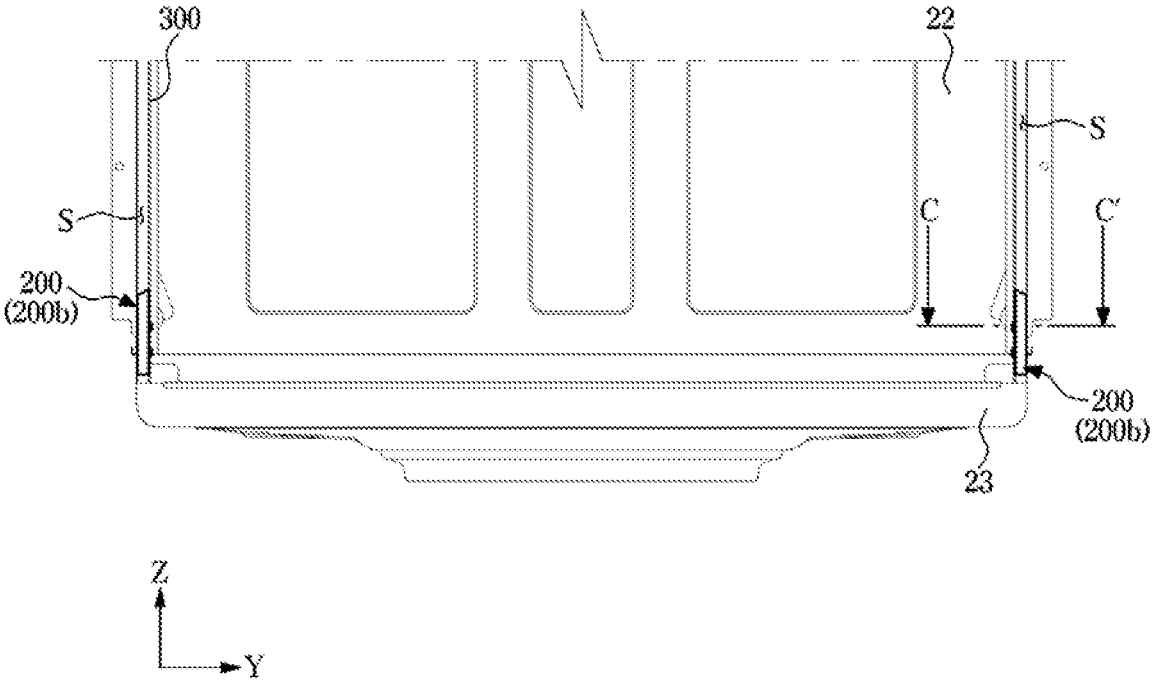
FIG. 21 is a front view illustrating the bracket coupled to the first region of the tub and a mounting member coupled to a first seaming portion according to another embodiment of the present disclosure.
Figure 22:
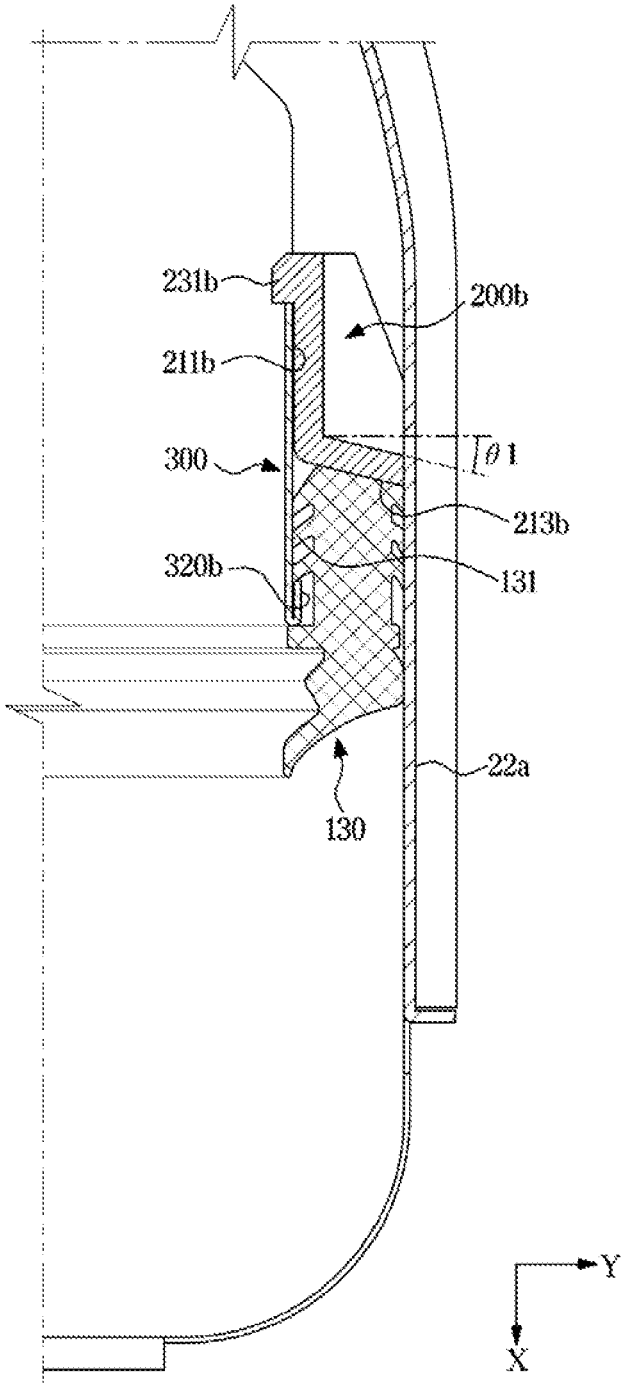
FIG. 22 is a sectional view taken along line C-C' of FIG. 21, particularly illustrating a sealing member mounted to the tub, the bracket, and the mounting member.

FIG. 19 is a view illustrating a state in which the second mounting member shown in FIG. 16 is coupled to the second seaming portion of the tub, FIG. 20 is a view illustrating a bracket coupled to a first region of the tub and a mounting member coupled to the second seaming portion according to another embodiment of the present disclosure, FIG. 21 is a front view illustrating the bracket coupled to the first region of the tub and a mounting member coupled to a first seaming portion according to another embodiment of the present disclosure, and FIG. 22 is a sectional view taken along line C-C' of FIG. 21, particularly illustrating a sealing member mounted to the tub, the bracket, and the mounting member. A description of the content the same as the above-described content will be omitted.

As illustrated in FIGS. 19 to 22, the second mounting member 200*b* may be coupled to the first region 140 of the tub 20 to allow the sealing member 130 to be mounted in the accommodation space S between the bracket 300 coupled to the second region 150 and 150*a* of the tub 20, and the tub 20.

The first region 140 of the tub 20 may be formed by the second region 150 formed on the middle panel 22 and the second region 150*a* formed on the lower panel 23. The second seaming portion 120 of the tub 20 may be formed by coupling the middle panel 22 to the lower panel 23.

The second region 150*a* formed on the lower panel 23 may extend integrally from the lower surface 23*a*. Particularly, in order to form opposite side surfaces 22*a* of the tub 20, the second region 150*a* of the lower panel 23 may be bent upward from opposite ends of the lower surface 23*a* and extend. The second region 150*a* formed on the lower panel 23 may include a plate portion 151*a* protruding inward to allow the bracket 300 to be coupled thereto, a bent portion 152*a* formed to be stepped to allow the sealing member 130 to be contacted thereto, and a round portion 153*a* formed to be rounded to allow the second mounting member 200*b* to be coupled thereto. The round portion 153*a* of the second region 150*a* may be formed at a front end of the tub 20.

The second mounting member 200*b* may be coupled to the first region 140. The contact surface portion 213*b* of the second mounting member 200*b* may be inclined to be similar to or equal to the shape of the bent portions 152 and 152*a* formed in the tub 20. The second mounting member 200*b* may be supported so as not to be moved and separated toward the inside of the tub 20 by the wing portion 215*b* and the flange portion 214*b* formed to extend vertically of the mounting body 210*b*.

Further, because the bracket 300 is locked by the separation prevention portion 230*b* formed to protrude from the rear end of the mounting body 210*b*, it is possible to prevent the second mounting member 200*b* from being separated toward the front side of the tub 20.

The second mounting member 200*b* may be installed in the second seaming portion 120 of the tub 20. The second mounting member 200*b* may be symmetrically installed on both left and right sides of the tub 20.

The sealing member 130 disposed on the tub 20 of the dishwasher 1 may be inserted into and coupled to the accommodation space S formed between the bracket 300 fixed to the second region 150 and 150*a* of the tub 20, and the side surface 22*a* of the tub 20.

Particularly, the sealing member 130 may be inserted into the accommodation space S formed between the bracket 300 fixed to the plate portion 151 and 151*a* of the second regions 150 and 150*a*, and the side surface 22*a* of the tub 20.

The sealing member 130 may be inserted between the bracket 300 fixed to the plate portion 151 and 151*a* of the second region 150 and 150*a*, and the side surface 22*a* of the tub 20, and the sealing member 130 may be stably mounted and fixed by the mounting member 200 inserted into the bent portion 152 and 152*a* of the second region 150 and 150*a* and the first region 140.

The contact surface portion 213*b* formed on the front surface of the second mounting member 200*b* may be formed at a predetermined angle θ1 to correspond to the bent portion 152 and 152*a* of the tub 20. The angle θ1 of the bent portion 152 and 152*a* of the second region 150 and the angle θ1 of the contact surface portion 213*b* of the second mounting member 200*b* may be formed to be the same. Accordingly, the sealing member 130, which is mounted to the bent portion 152, and 152*a* of the tub 20, may be mounted at the same position and angle as the bent portions 152 and 152*a* of the tub 20 and the contact surface portion 213*b* of the second mounting member 200*b*.

Figure 23:
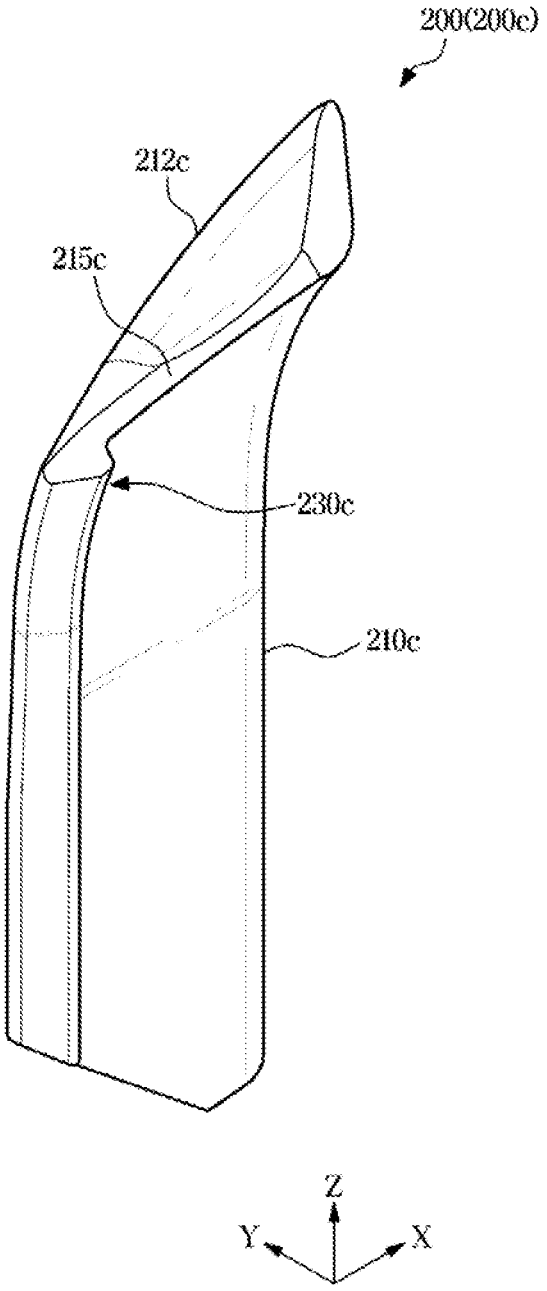
FIGS. 23 and 24 are perspective views illustrating a mounting member according to another embodiment of the present disclosure.
Figure 24:
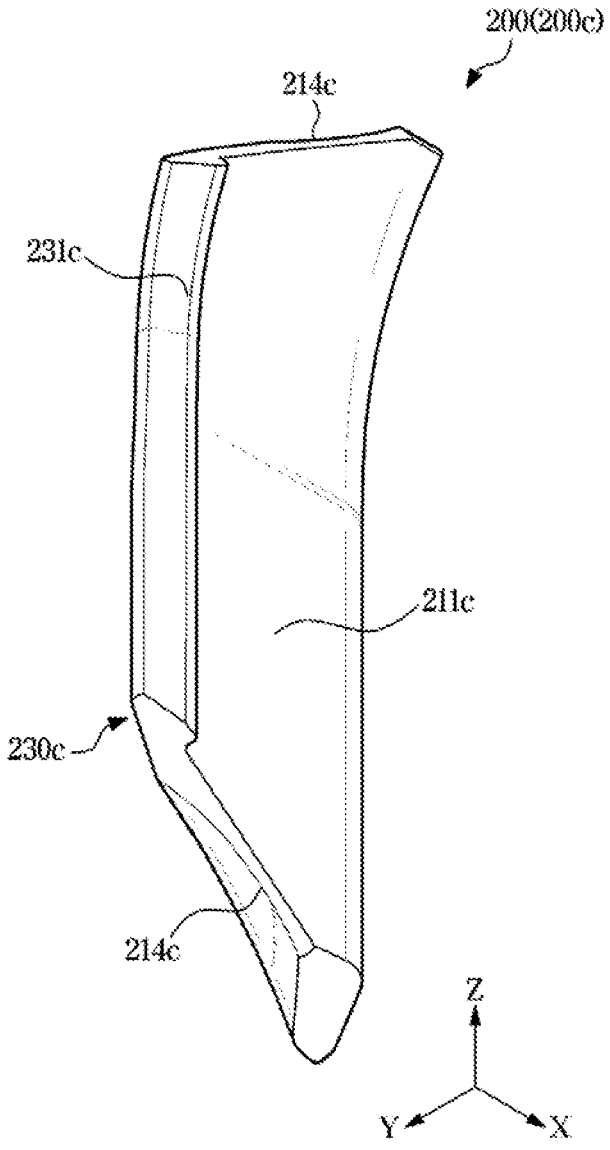
Figure 25:
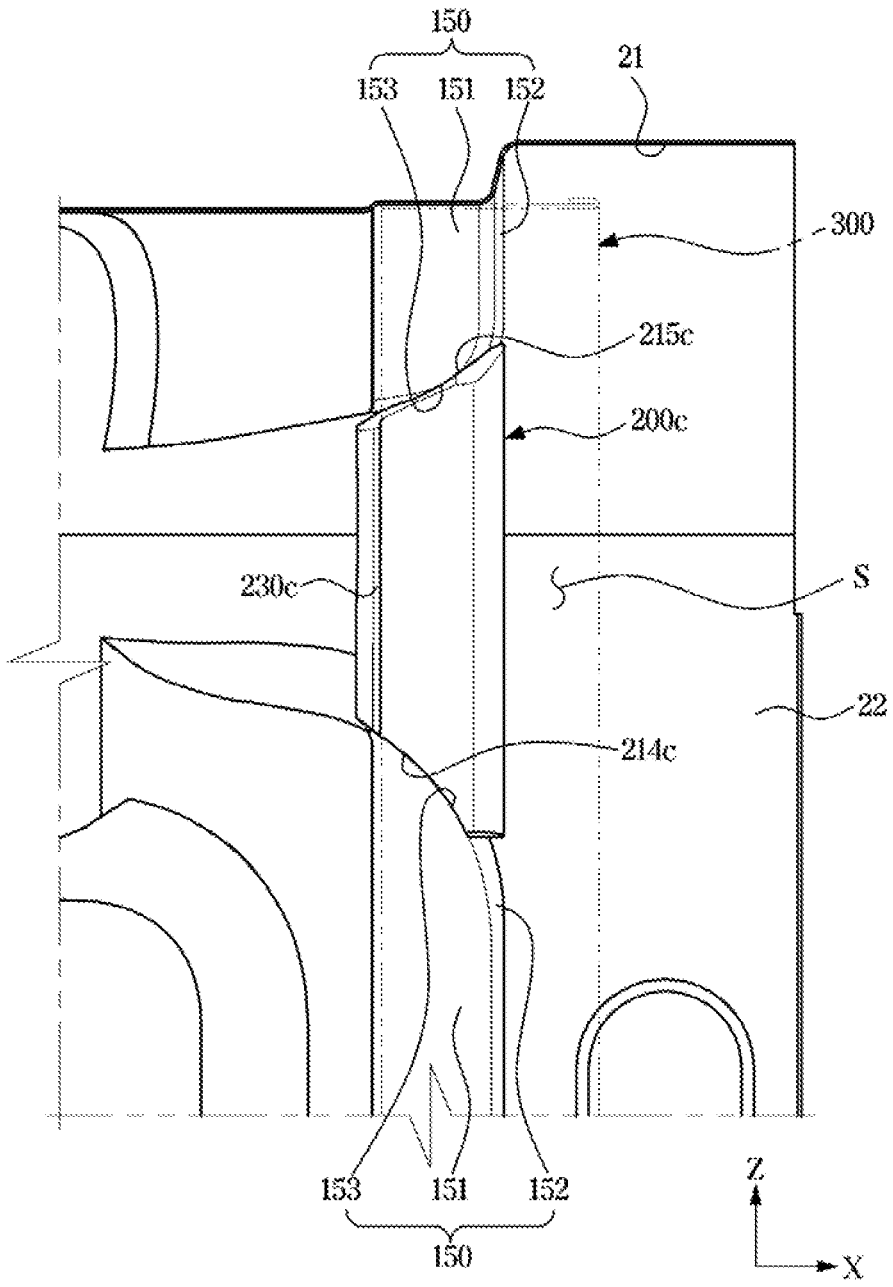
FIG. 25 is a view illustrating a state in which the mounting member is mounted to a tub according to another embodiment of the present disclosure.
Figure 26:
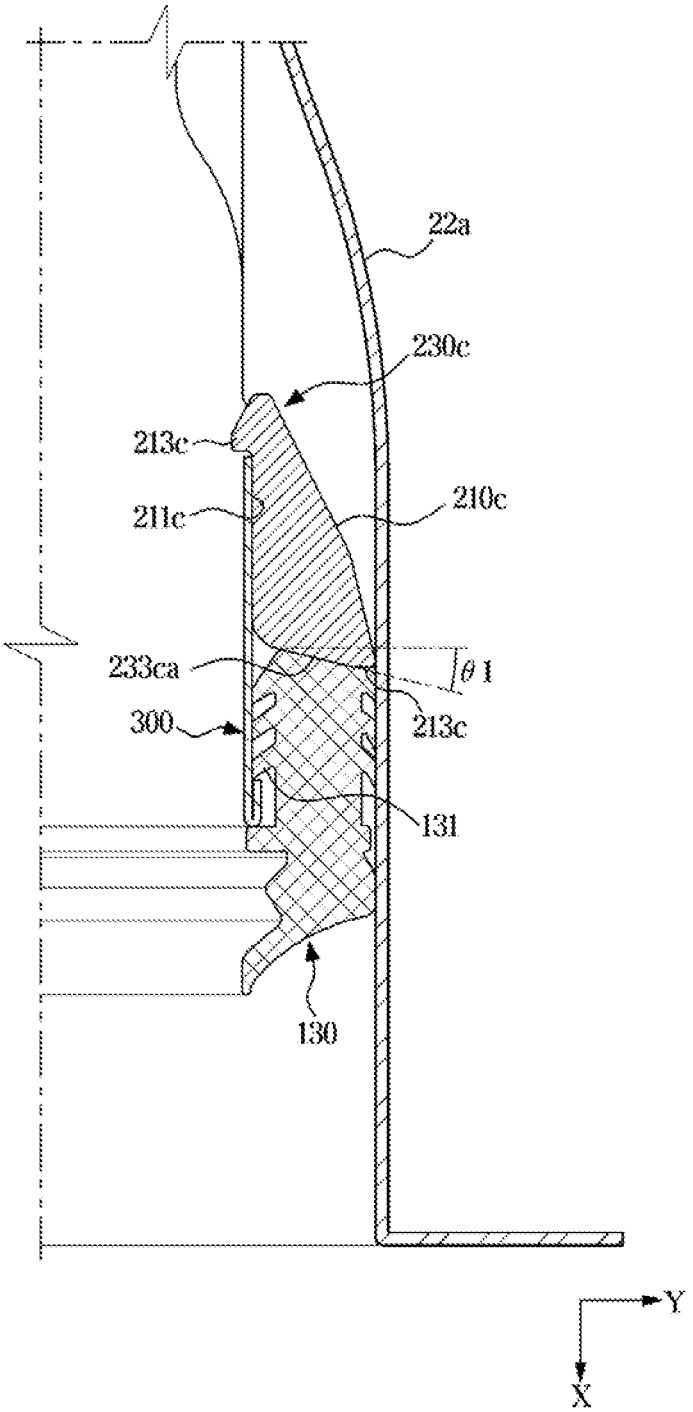
FIG. 26 is a cross-sectional view illustrating a state in which a sealing member is inserted into the tub, to which the mounting member is mounted, and a bracket according to another embodiment of the present disclosure.

FIGS. 23 and 24 are perspective views illustrating a mounting member according to another embodiment of the present disclosure, FIG. 25 is a view illustrating a state in which the mounting member is mounted to a tub according to another embodiment of the present disclosure, and FIG. 26 is a cross-sectional view illustrating a state in which a sealing member is inserted into the tub to which the mounting member is mounted and a bracket according to another embodiment of the present disclosure. A description of the content the same as the above-described content will be omitted.

As illustrated FIGS. 23 to 26, a mounting member 200C may be coupled to a seaming portion 100 of a tub 20, that is a first region 140, so as to allow a sealing member 130 to be mounted on an accommodation space S formed between a bracket 300 coupled to a bracket coupling portion 150 of the tub 20, that is a second region 150, and the tub 20.

The mounting member 200C mounted to the tub 20 may include a mounting body 210C, and a separation prevention portion 230C formed a rear end of the mounting body 210C.

The mounting member 200C may be formed of a plastic, rubber, or stainless-steel material. The mounting member 200C may be formed of an elastic material so as to be forcibly inserted between the first portion 140 of the tub 20 and the bracket 300.

The mounting body 210C of the mounting member 200C may include a flat surface portion 211C formed to be flat to be in contact with and supported by one surface of the bracket 300, an inclined surface portion 212C formed to be in contact with and supported by the inner surface of the tub 20, and a contact surface portion 213C formed in front of the flat surface portion 211C and the inclined surface portion 212C.

The flat surface portion 211C of the mounting body 210C may be formed in a corresponding flat surface to be in surface contact with and supported by the bracket 300.

The contact surface portion 213C of the mounting body 210C may be provided to form the front surface of the mounting member 200C. The contact surface portion 213C may be formed to allow at least a portion of the sealing member 130 to be contacted thereto. The contact surface portion 213C may further include a flange portion 214C formed to closely support between the bracket 300 and the tub 20. The flange portion 214C may be provided to support the mounting member 200C to prevent the mounting member 200C from being separated toward the inside of the tub 20. The flange portion 214C may be formed in a lower portion of the mounting body 210C. The flange portion 214C may be formed in a shape corresponding to a round portion 153 of the second region 150. The flange portion 214 may be formed to correspond to a curvature of the corresponding round portion 153.

The mounting body 210C may further include a wing portion 215C formed to closely support between the bracket 300 and the tub 20. The wing portion 215C may be formed in an upper portion of the mounting body 210C. The wing portion 215C may be formed to correspond to the curvature of the round portion 153 of the corresponding second region 150.

By the flange portion 214C and the wing portion 215C of the mounting body 210C, it is possible to prevent the mounting member 200C from being moved and separated toward the inside of the tub 20.

The contact surface portion 213C of the mounting member 200C may further include an inclined surface 213Ca formed to be inclined at a predetermined angle θ1 to correspond to an inclination of the bent portion 152.

The mounting member 200C may further include a separation prevention portion 230C for preventing separation.

The separation prevention portion 230C may include a locking protrusion 231C protruding from a rear end of the mounting body 210C. The separation prevention portion 230C may be formed by protruding at least a portion of the mounting body 210C. The locking protrusion 231C may be formed by protruding at least a portion of the mounting body 320C. The separation prevention portion 230C may be formed by protruding a rear end of the flat surface portion 211C. The locking protrusion 231C may be formed by protruding the rear end of the flat surface portion 211C.

In the embodiment of the present disclosure, a case in which the separation prevention portion 230A of the mounting member 200C includes a single locking protrusion 231C has been described as an example, but is not limited thereto. For example, the number of locking protrusions may vary according to the size and shape of the mounting member.

While the present disclosure has been particularly described with reference to exemplary embodiments, it should be understood by those of skilled in the art that various changes in form and details may be made without departing from the spirit and scope of the present disclosure.

What is claimed is:

1. A dishwasher comprising:
a main body;
a tub in the main body and configured to form a washing space, the tub having an opening and having at least two panels with a seam between the at least two panels;
a door configured to open and close the opening in the tub;
a bracket coupled to an inner surface of the tub to form an accommodation space between the tub and the bracket;
a seal disposed in the accommodation space and configured to provide a seal between the tub and the door; and
a mount on the seam in the tub to mount the seal in the accommodation space.

2. The dishwasher of claim 1, wherein
the tub further comprises a bracket coupler configured to protrude from the tub at a position adjacent to the door to couple to the bracket to be coupled thereto.

3. The dishwasher of claim 2, wherein
the bracket coupler is formed by a portion of the tub that protrudes inward.

4. The dishwasher of claim 2, wherein the bracket coupler further comprises:
a plate portion configured to protrude inward of the tub; and
a bent portion configured to extend to be stepped from the plate portion.

5. The dishwasher of claim 2, wherein the mount comprises
a flat surface portion configured to be in contact with and supported by a surface of the bracket;
an inclined surface portion configured to be in contact with and supported by the seam; and
a contact surface portion in front of the flat surface portion and the inclined surface portion so as to be in contact with the seal.

6. The dishwasher of claim 5, wherein
the contact surface portion further comprises an inclined portion having an inclination corresponding to the bracket coupler.

7. The dishwasher of claim 1, wherein
the at least two panels of the tub comprise an upper panel, a lower panel, and a middle panel, and
the seam comprises a seaming portion including
a first seaming portion formed between the upper panel and the middle panel; and
a second seaming portion formed between the lower panel and the middle panel.

8. The dishwasher of claim 7, wherein
the mount is provided in at least one of the first seaming portion and the second seaming portion.

9. The dishwasher of claim 1, wherein the bracket has an I-shaped cross-section.

10. The dishwasher of claim 9, wherein the bracket further comprises a protrusion having one end which protrudes inward to inhibit separation of the seal.

11. The dishwasher of claim 1, wherein the mount comprises:
a mounting body; and
a separation prevention portion extending from the mounting body.

12. The dishwasher of claim 1, wherein the mount further comprises:
a flange shaped to support the bracket and the seam; and
a wing to inhibit the mount from being separated toward an inside of the tub.

13. The dishwasher of claim 1, wherein the mount comprises a plastic or rubber or stainless-steel material.

14. The dishwasher of claim 1, wherein
the bracket and the tub are coupled by at least one of welding, clinching, bonding, riveting, and screwing.

15. A dishwasher comprising:
a main body;
a tub in the main body and configured to form a washing space, the tub having an opening and a seam between at least two panels forming the tub;
a door configured to open and close the opening of the tub;
a bracket extending from an inner surface of the tub to form a gap between the tub and the bracket;
a coupler coupled to the bracket and positioned on the seam in the tub;
a seal positioned in the space between the tub and the bracket and supported by the coupler to seal the gap between the tub and the bracket.

* * * * *